US007862164B2

(12) United States Patent
Ishikawa et al.

(10) Patent No.: US 7,862,164 B2
(45) Date of Patent: Jan. 4, 2011

(54) INK JET RECORDING APPARATUS AND RECORDING METHOD THEREFOR

(75) Inventors: Kouhei Ishikawa, Kawasaki (JP); Hideaki Kishida, Kawasaki (JP); Mitsuhiro Mukasa, Kawasaki (JP); Kenichi Tsuburaya, Yokohama (JP); Hirotaka Okuwaki, Yokohama (JP); Yoichi Sonobe, Kawasaki (JP); Ryuchi Kojima, Tokyo (JP)

(73) Assignee: Canon Finetech, Inc., Misato-shi (JP)

( * ) Notice: Subject to any disclaimer, the term of this patent is extended or adjusted under 35 U.S.C. 154(b) by 0 days.

(21) Appl. No.: 10/206,985

(22) Filed: Jul. 30, 2002

(65) Prior Publication Data

US 2002/0191064 A1 Dec. 19, 2002

Related U.S. Application Data

(62) Division of application No. 09/615,064, filed on Jul. 12, 2000, now Pat. No. 6,471,351.

(30) Foreign Application Priority Data

| | | |
|---|---|---|
| Jul. 14, 1999 | (JP) | 11-200976 |
| Jul. 14, 1999 | (JP) | 11-200984 |
| Jul. 14, 1999 | (JP) | 11-200985 |
| Jun. 16, 2000 | (JP) | 2000-182098 |

(51) Int. Cl.
*B41J 29/38* (2006.01)
*B41J 2/01* (2006.01)

(52) U.S. Cl. ..... 347/104; 347/16

(58) Field of Classification Search ..... 347/2, 347/5, 9, 14, 37, 104, 8, 16
See application file for complete search history.

(56) References Cited

U.S. PATENT DOCUMENTS

| | | | | |
|---|---|---|---|---|
| 4,085,837 | A * | 4/1978 | Takano et al. | 400/583 |
| 5,291,227 | A | 3/1994 | Suzuki | 347/104 |
| 5,397,192 | A * | 3/1995 | Khormaee | 347/37 |
| 5,702,191 | A | 12/1997 | Kakizaki et al. | 460/582 |
| 5,953,035 | A | 9/1999 | Watanabe et al. | 347/104 |
| 6,109,745 | A * | 8/2000 | Wen | 347/5 |

(Continued)

FOREIGN PATENT DOCUMENTS

EP 0496300 A2 * 7/1992

(Continued)

*Primary Examiner*—Julian D Huffman
(74) *Attorney, Agent, or Firm*—Fitzpatrick, Cella, Harper & Scinto

(57) ABSTRACT

An ink jet recording apparatus, which records a image on a recording medium using a recording head provided with a plurality of ink discharge ports, comprises a rotative platen having a plurality of supporting pieces arranged at predetermined intervals; rotation means for rotating the platen; conveyance means for conveying the recording medium; control means for controlling the rotation means to rotate the platen in the conveying direction of the recording medium in synchronism with the conveyance of the recording medium when recording is performed near the edge of the recording medium conveyed by the conveyance means. With the structure thus arrange, this ink jet recording apparatus is capable of performing the entire area recording (no margin recording) on a recording medium without staining the platen that supports the recording medium at the time of recording.

6 Claims, 27 Drawing Sheets

U.S. PATENT DOCUMENTS

| | | | | |
|---|---|---|---|---|
| 6,118,467 | A | 9/2000 | Park | |
| 6,126,345 | A | 10/2000 | Ito et al. | 400/624 |
| 6,155,728 | A | 12/2000 | Sakaino et al. | 400/26 |
| 6,172,688 | B1 | 1/2001 | Iwasaki et al. | 347/2 |
| 6,239,817 | B1 * | 5/2001 | Meyer | 347/36 |

FOREIGN PATENT DOCUMENTS

| | | | |
|---|---|---|---|
| EP | 0783977 | A2 * | 7/1997 |
| EP | 0818320 | A2 * | 1/1998 |
| JP | 57-32971 | | 2/1982 |
| JP | 3-277572 | * | 12/1991 |
| JP | 7-25083 | | 1/1995 |
| JP | 7-164696 | | 6/1995 |

* cited by examiner

INK JET RECORDING APPARATUS AND RECORDING METHOD THEREFOR

This application is a division of application Ser. No. 09/615,064 filed Jul. 12, 2000.

BACKGROUND OF THE INVENTION

1. Field of the Invention

The present invention relates to an ink jet recording apparatus that conveys a recording medium for recording images on it by use of an ink jet method. The invention also relates to a recording method therefor.

2. Related Background Art

An ink jet recording apparatus forms droplets of ink by various methods and discharges them onto a recording medium, such as recording paper, for recording by the adhesion of the ink droplets to the recording medium. Particularly, the ink jet recording apparatus that utilizes heat as energy for forming the discharge droplets makes it easier to arrange a plurality of discharge ports (nozzles) in high density. Then, with the nozzles thus arranged in high density, the ink jet recording apparatus can provide high quality images in high resolution at high speeds to make it easier to form color images. These are excellent features. Since the ink jet recording apparatus discharges ink onto a recording medium in accordance with a recording signal, it is used widely as a quiet recording method which is applicable at lower running costs.

Now, with the ink jet recording apparatus thus structured, it may be desired to perform recording on the entire recording area (recording without any margins) on a recording medium in order to obtain an image recorded in the same size as that of the recording medium. However, when operating such an entire area recording, it is required to provide highly precise positioning with respect to the relative relations between the recording medium and the ink jet recording head. Actually, therefore, the positional deviation may take place between the recorded image and the recording medium so that a small amount of ink is discharged outside the recording medium, and the platen of the apparatus is stained. Moreover, in some cases, a margin may be produced on the recording medium to the extent that ink is discharged onto the platen. In order to prevent the creation of such a margin on a recording medium due to the errors existing in the relative positions between the recording medium and the ink jet recording head, it may be possible to record an image in a size larger than that of the recording medium. In this case, however, a problem is encountered that the amount of ink that may be discharged outside the recording medium becomes greater to eventually stain the platen. If the platen is stained by ink, there occurs such trouble that the front side or the reverse side of the recording medium carried to the position of the platen is stained by ink that has adhered to the platen, and the recording medium on which images are recorded is made worthless.

Further, if recording is performed on a recording medium which has been carried obliquely a large amount of ink is discharged on the platen, and not onto the recording medium eventually. Then, the recording apparatus itself may be damaged. Furthermore, when recording should be made on the trailing edge of the recording medium, it is required to continuously record on the recording medium even after the recording medium has passed the conveying roller which is positioned on the entrance side of the recording unit. However, while the recording medium is being conveyed in this manner, errors tend to take place in the conveying amount of the recording medium due to the kicking out thereof by the conveying roller on the entrance side at the moment the recording medium passes over the position of the conveying roller on that side (that is, the moment the trailing edge of the recording medium has passed through the roller on the entrance side). As a result, a problem is encountered that a margin is created inevitably between the image recorded by the scanning of the recording head before the kick-out of the recording medium and the one recorded by the scanning of the recording head after the kick-out of the recording medium.

SUMMARY OF THE INVENTION

It is an object of the invention to provide an ink jet recording apparatus capable of performing the entire area recording (no margin recording) on a recording medium without staining the platen that supports the recording medium at the time of recording, and also, to provide a recording method therefor.

It is another object of the invention to provide an ink jet recording apparatus provided with a platen which is applicable to recording mediums of various sizes, as well as to provide a recording method therefor.

It is still another object of the invention to provide an ink jet recording apparatus capable of performing the entire area recording on a recording medium, while preventing the interior of the apparatus from being stained by ink discharged outside the recording medium, and also to provide a recording method therefor.

It is a further object of the invention to provide an ink jet recording apparatus capable of correcting the oblique conveyance of a recording medium and/or preventing the recording medium from being kicked out in order to convey the recording medium in high precision for recording, and also, to provide a recording method therefor.

DETAILED DESCRIPTION OF THE PREFERRED EMBODIMENTS

Hereinafter, with reference to the accompanying drawings, the preferred embodiments will be described in accordance with the present invention.

First Embodiment

Figure 1:
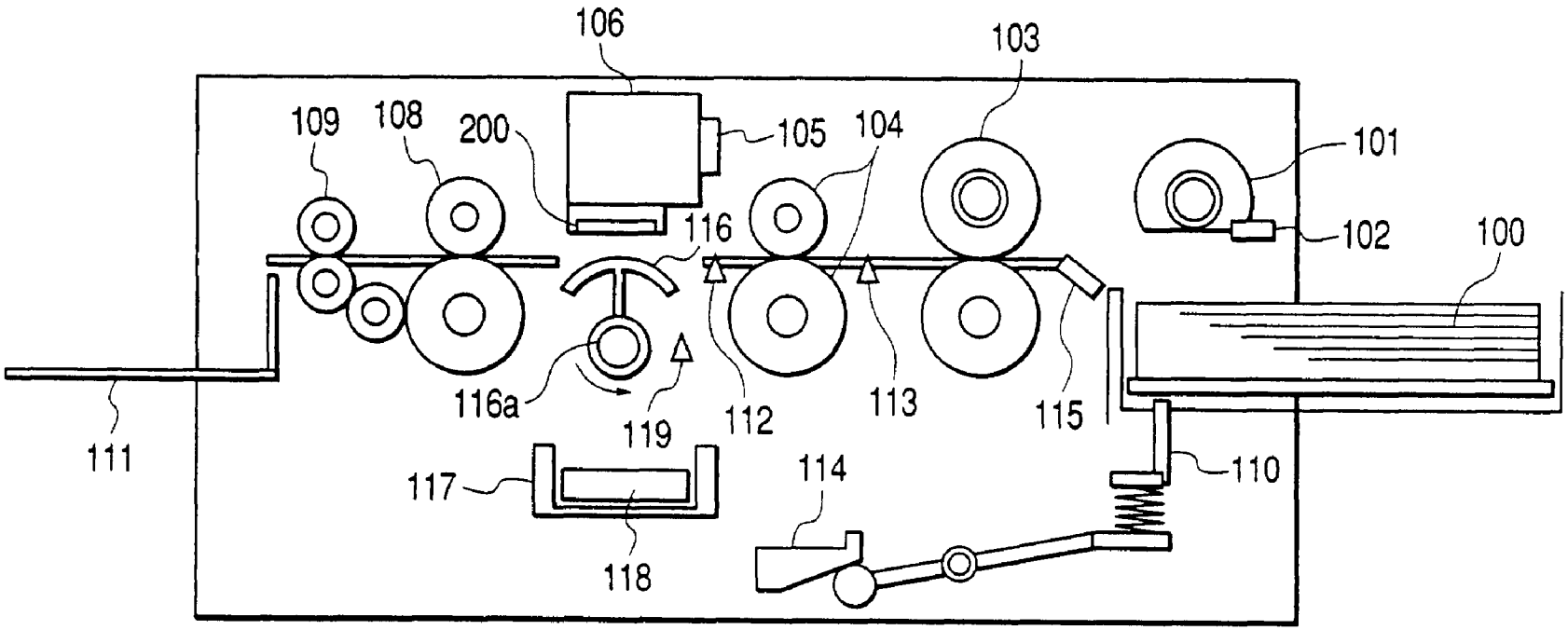
FIG. 1 is a side view which shows the recording unit of a color ink jet recording apparatus in accordance with an embodiment of the present invention.
Figure 2:
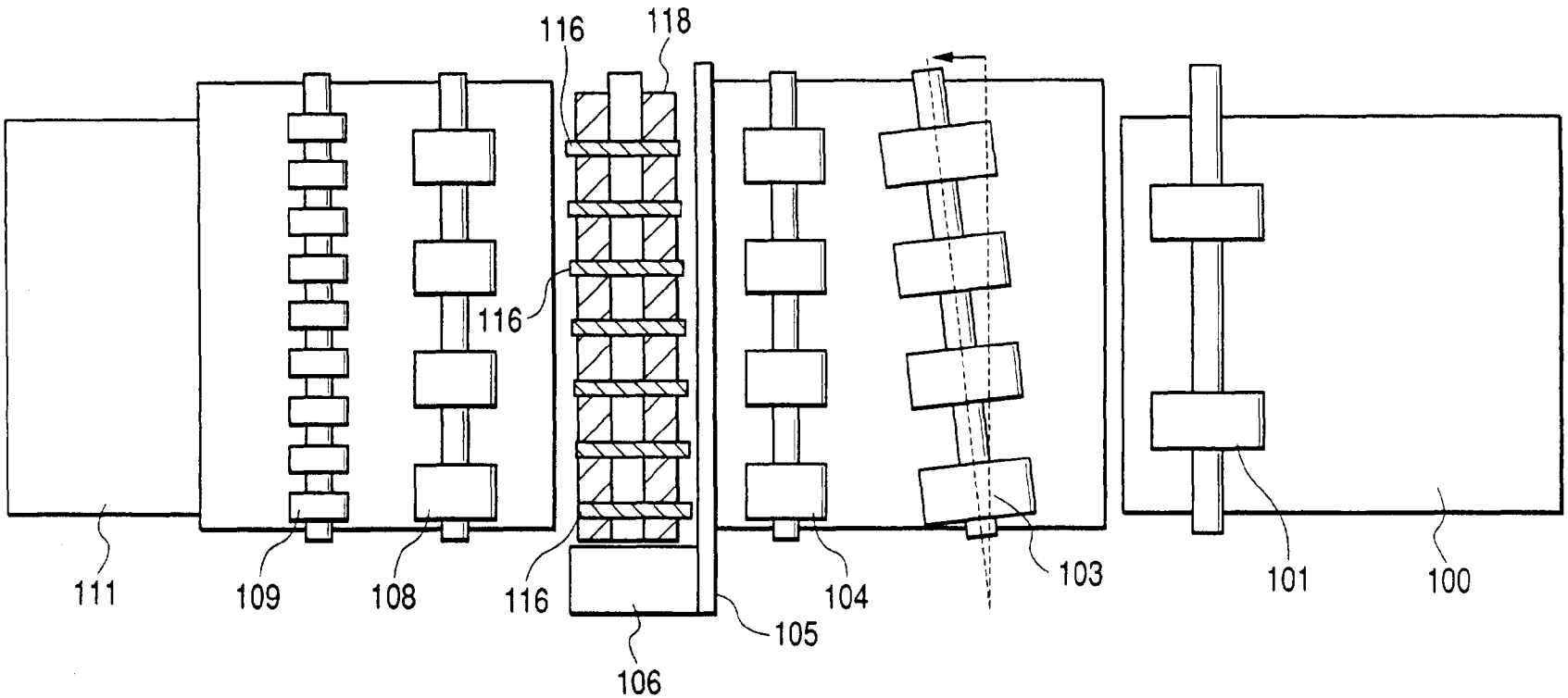
FIG. 2 is a plan view which illustrates the color ink jet recording apparatus in accordance with the embodiment of the present invention.

FIG. 1 is a side sectional view which shows a color ink jet recording apparatus in accordance with an embodiment of the present invention. FIG. 2 is the plan view thereof.

In FIG. 1, reference numeral 100 designates a recording medium (recording paper sheet) contained in a sheet cassette where plural numbers of recording mediums 100 are stacked; 101, a paper feed roller (a semicircular pickup roller) to pickup the recording medium 100 from the sheet cassette by the rotation thereof and feed it for its conveyance; 102, a home position sensor for detecting whether or not the rotational position of the paper feed roller 101 is at the home position thereof; 110, a hopper arm to bias the sheet cassette upward so that the paper feed roller 101 is in contact with the recording medium 100 even when the number of remaining sheets of the recording medium 100 decreases; 103, an oblique conveyance roller and 104, a conveyance roller, which convey the recording medium 100 fed by the paper feed roller 101 in the direction toward the recording position of a recording head 200, while correcting any oblique conveyance thereof; 112, a conveyance sensor to detect the arrival of the recording medium 100; and 113, an oblique conveyance sensor to detect the arrival of the recording medium 100. Reference numerals 108 and 109 designate discharge rollers to discharge a recording medium after recording, and a reference numeral 111 designates a discharged paper tray to contain the recording medium after recording. Also, a reference numeral 200 designates a recording head, which is an ink jet head here; 106, an ink cartridge; and 105, a belt used for moving the recording head 200.

One feature of this color ink jet recording apparatus is that the platen 116 supports the recording medium 100 to face the recording head 200 and is provided with a plurality of partitions (supporting pieces), and that the apparatus is devised to rotate the platen 116 by the rotation of the shaft 116*a* that shareably supports the partitions so as to perform recording using the recording head. Further, below the partitioning platen 116, there is provided a receptacle dish 117 on which an absorbent 118 is set to receive ink discharged outside the recording medium when ink is discharged from all the nozzles of the recording head 200. Here, reference numeral 114 designates a member that shifts the hopper arm 110 up and down. When this member shifts in the right direction, the hopper arm 110 rises, thus raising the recording medium 100.

In FIG. 2, the portions which are shared by those shown in FIG. 1 are designated by the same reference numerals. Here, the recording head 200 moves in the direction perpendicular to the surface of FIG. 1, and in the up and down directions with respect to the surface of FIG. 2. The recording medium 100 is driven to be conveyed in the left direction from the right side in FIG. 2 for recording performed by the recording head 200.

Figure 3:
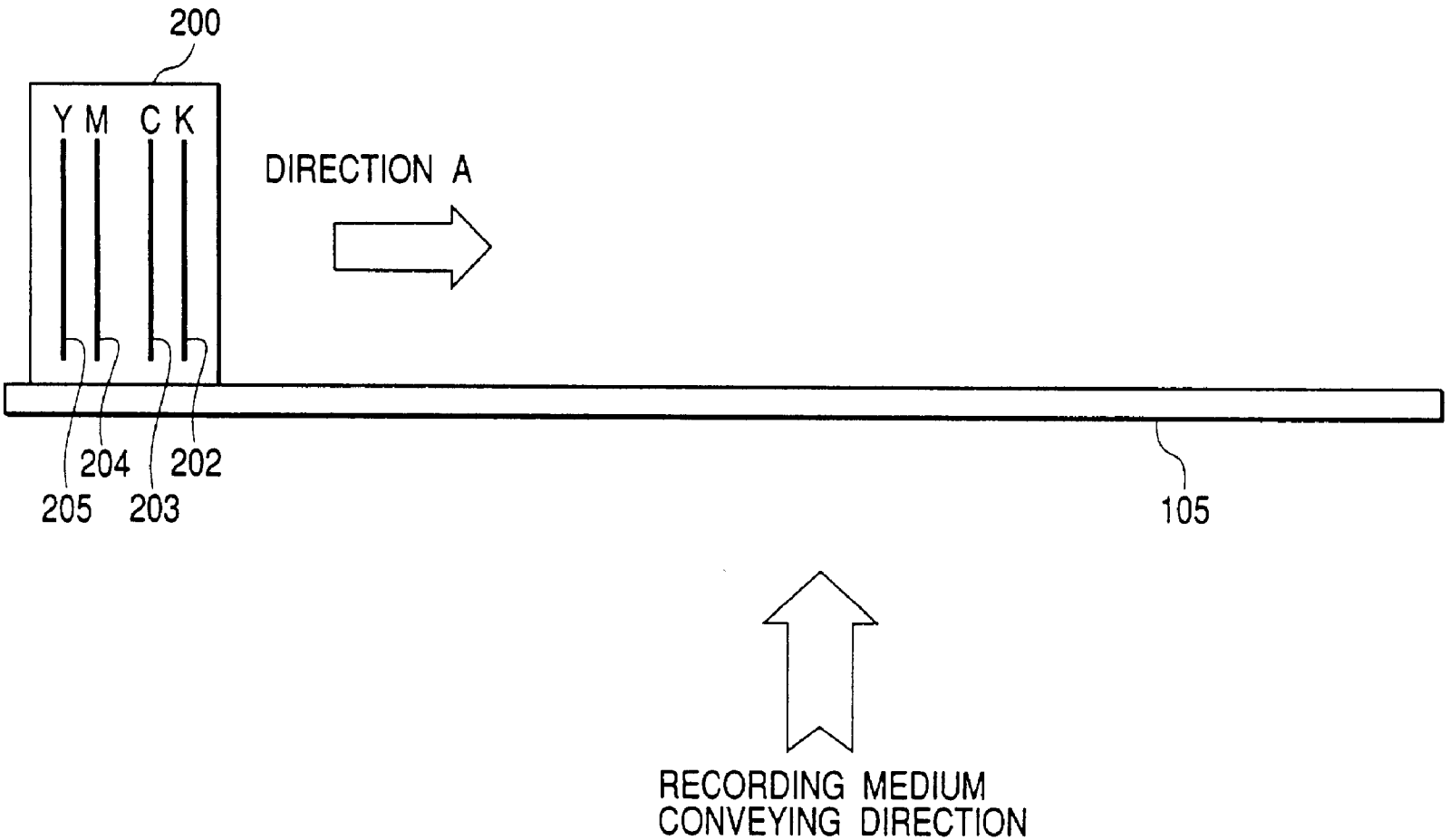
FIG. 3 is a view which illustrates the scanning of the head of the recording unit of the color ink jet recording apparatus in accordance with the embodiment of the present invention.

FIG. 3 is a view which schematically shows the structure of the recording unit of a color ink jet recording apparatus in accordance with the embodiment of the present invention.

The recording unit comprises the YMCK four-color recording heads 202 to 205; an ink cartridge 200 formed integrally therewith; and a belt 105 that enables the ink cartridge 200 to scan. Here, each of the recording heads 202 to 205 is an ink jet head having 304 discharge ports (nozzles) in one line at the pitches of 600 dpi. Each of the recording heads is carried to the recording position to face the platen 116, and then driven in accordance with ink discharge driving signals. Then, the heads scan in the direction A, while discharging ink from each of the corresponding nozzles of the recording heads 202 to 205 (in the upward direction in FIG. 2). In this manner, recording of a plural-line portion is made per scan.

Figure 4B:
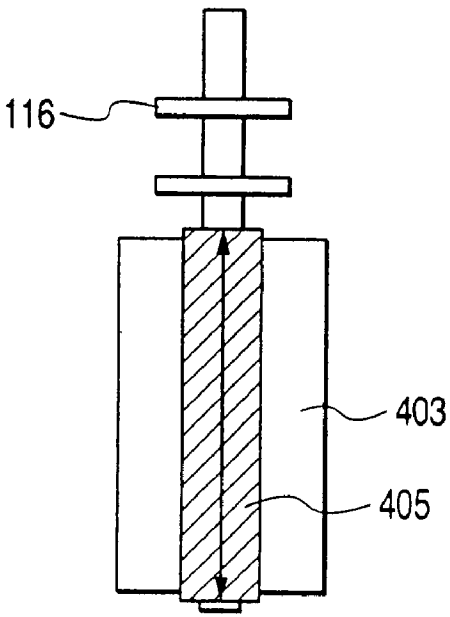
FIGS. 4A and 4B are views which illustrate the positional relations between the platen partitions of the color ink jet recording head and recording media in accordance with the embodiment of the present invention.
Figure 4A:
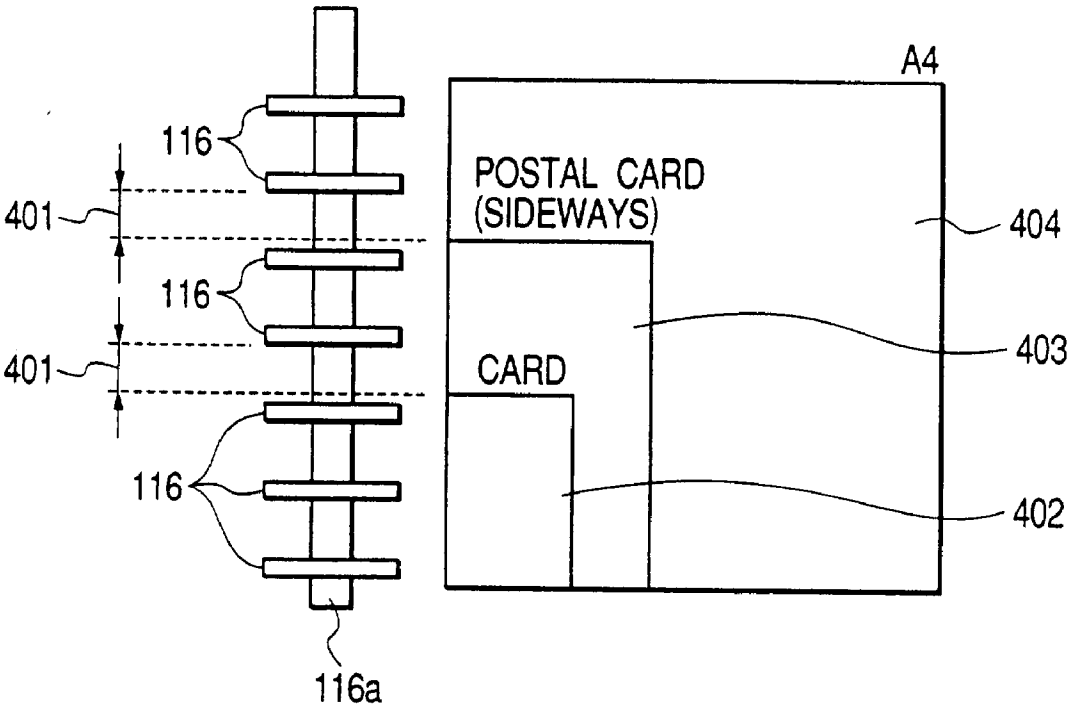

FIGS. 4A and 4B are views which illustrate the positional relations between the partitions of the plate 116 and the recording medium (recording paper sheet) 100 for the color ink jet recording apparatus in accordance with the embodiment of the present invention. Now, with reference to FIGS. 4A and 4B, the description will be made of a method for recording without any margin in the transverse direction of the recording medium (in the direction perpendicular to the conveying direction of the recording medium).

As shown in FIG. 4A, the partitions that form the platen 116 are arranged in the respective positions having each of the margins 401 corresponding to the card size 402, the postal card size 403 and the A-4 size 404, which are regular sizes for images recordable by the color ink jet recording apparatus, respectively.

FIG. 4B is a view which shows the example in which no margin recording is performed in the transverse direction when the size of a recording medium 100 is that of a postal card.

When recording is made on the recording medium 403 of the postal card size, an image 405 is recorded in a size which is larger by one step than the postal card size. Here, the partitions of the platen 116 are arranged with the margin 401 with respect to the postal card size. Therefore, even when the image 405 which is larger by one step than the postal card size is recorded, it becomes possible to perform no margin recording of the recording medium of the postal card size in the transverse direction without staining the partitions of the platen 116.

FIG. 5 to FIG. 11 are side sectional views which schematically illustrate the color ink jet recording apparatus embodying the present invention. Now, with reference to FIG. 5 to FIG. 11, the description will be made of the no margin recording in the longitudinal direction of a recording medium 100 (in the conveying direction of the recording medium).

Figure 5:
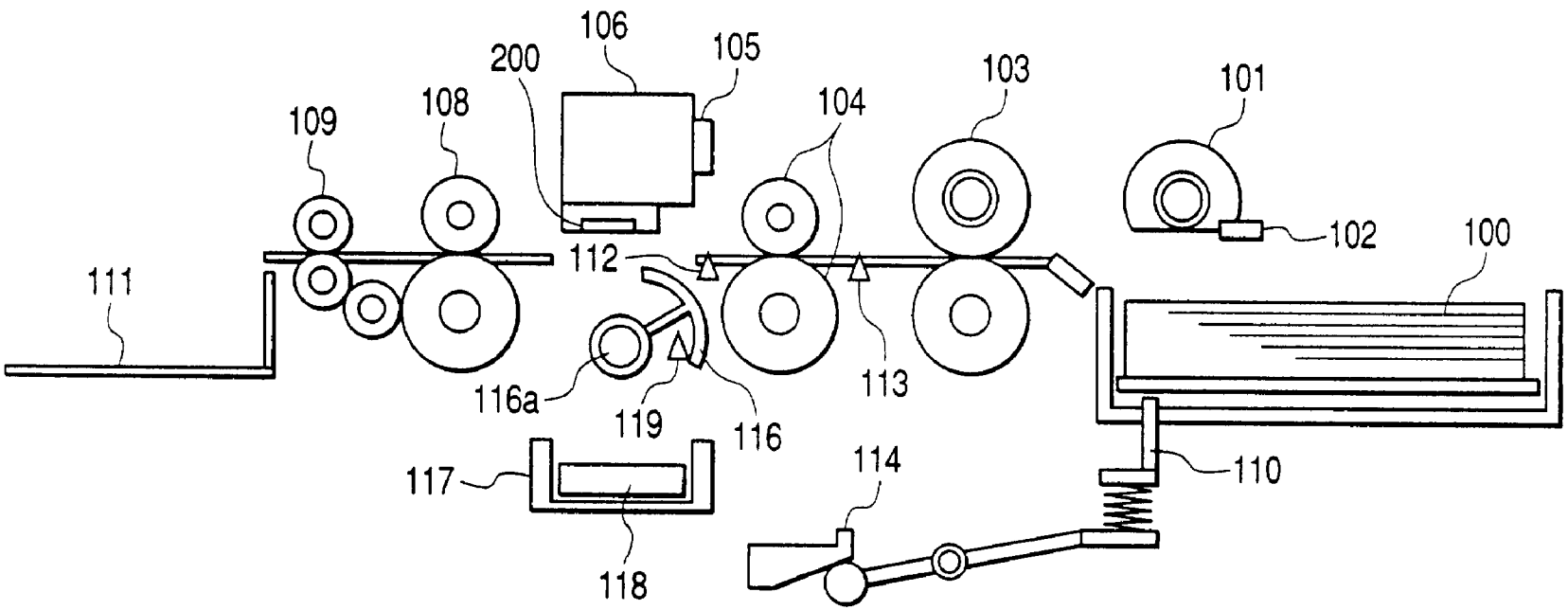
FIG. 5 is a side view which illustrates the initial state before the color ink jet recording apparatus starts recording in accordance with the embodiment of the present invention.

FIG. 5 is a view which shows the initializing state needed for performing the entire area recording. Here, the same reference marks are applied to the portions which are common to those appearing in FIG. 1 to FIGS. 4A and 4B, and the description thereof will be omitted. In this state, the platen 116 rotates and steps at the position where the home position sensor 119 detects the presence of the platen.

Figure 6:
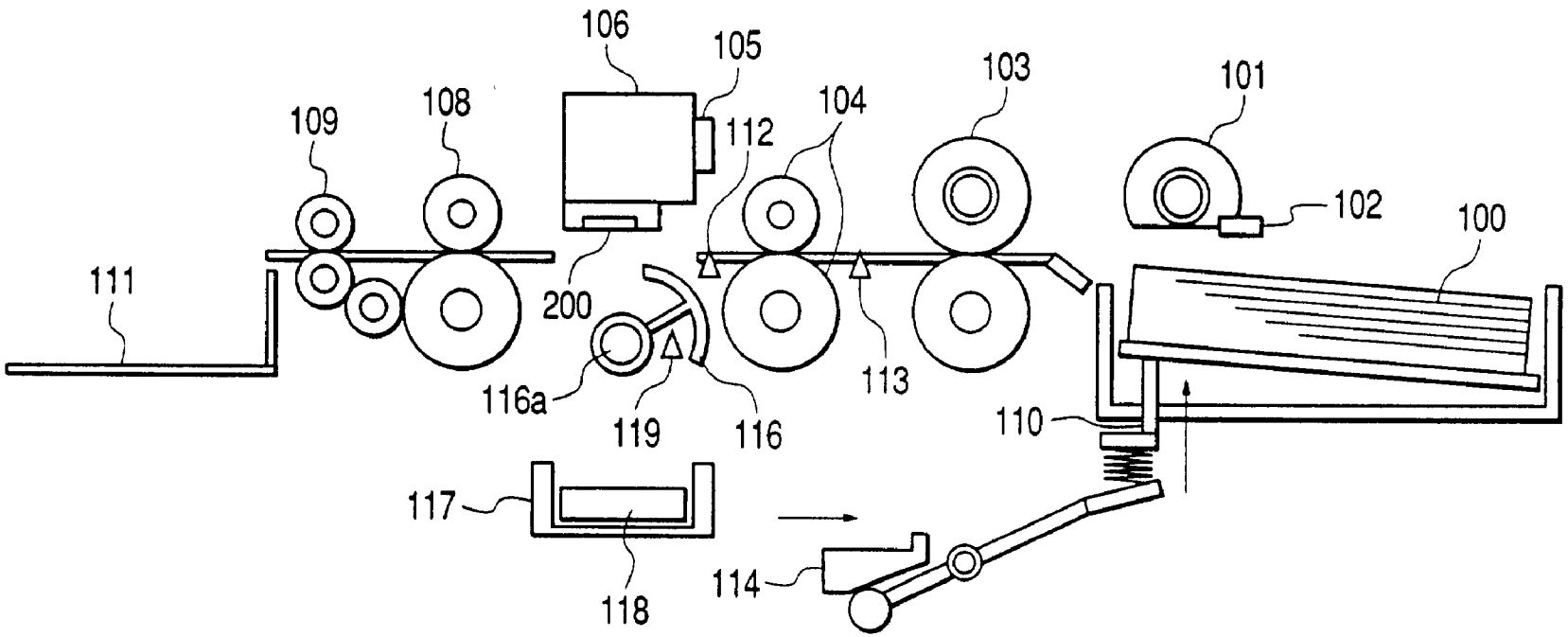
FIG. 6 is a side view which illustrates the state immediately before the color ink jet recording apparatus starts conveying a recording medium in accordance with the embodiment of the present invention.

FIG. 6 shows the state before the paper feeding operation begins. Here, the member 114 that moves the hopper arm 110 up and down shifts in the right direction to raise the hopper arm 110, thus enabling the recording medium 100 to rise.

Figure 7:
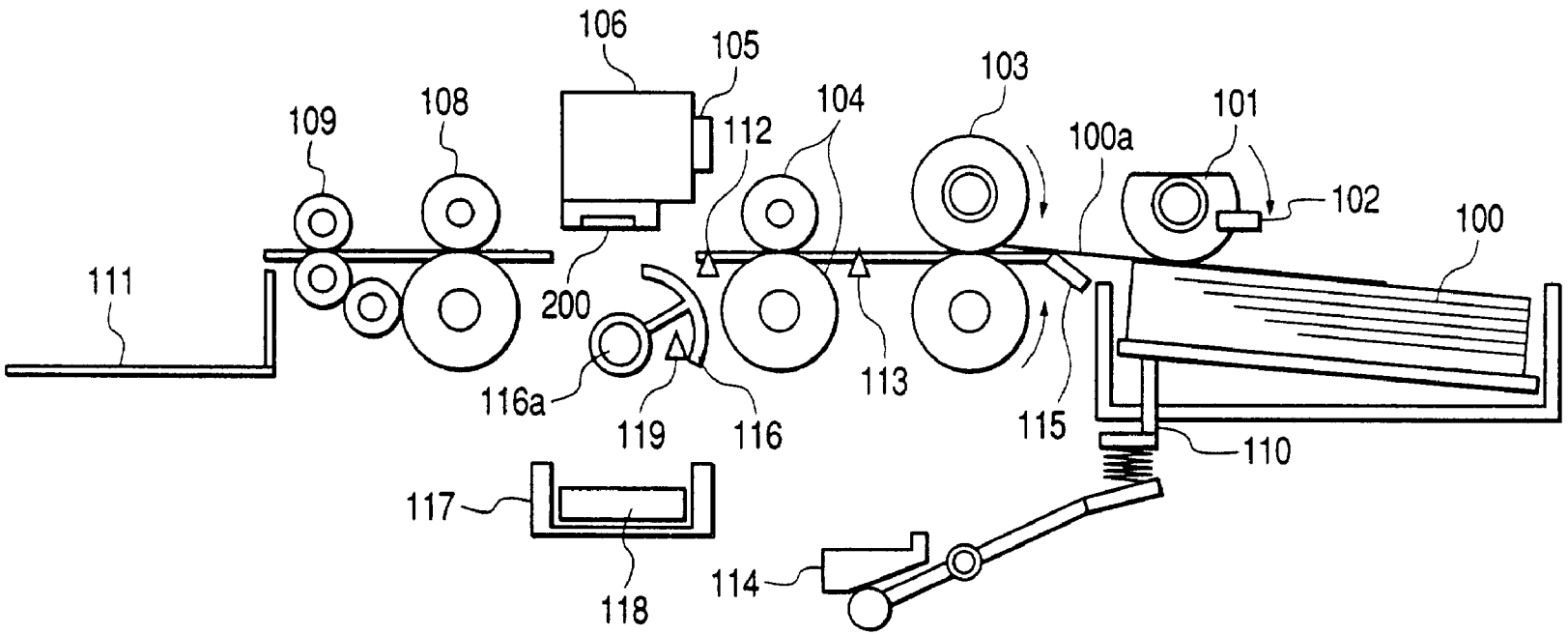
FIG. 7 is a side view which illustrates the state when the color ink jet recording apparatus starts feeding a recording medium in accordance with the embodiment of the present invention.

FIG. 7 shows the state in which the paper feeding operation has begun.

Here, the recording medium 100*a* on the uppermost position is picked by the rotation of the paper feed roller 101. The recording medium 100*a* abuts against the separation pad 115 that separates the recording mediums one by one for feeding it into the interior of the main body. Then, in the main body, the oblique conveyance roller 103 rotates to convey the recording medium 100*a* thus fed.

Figure 8:
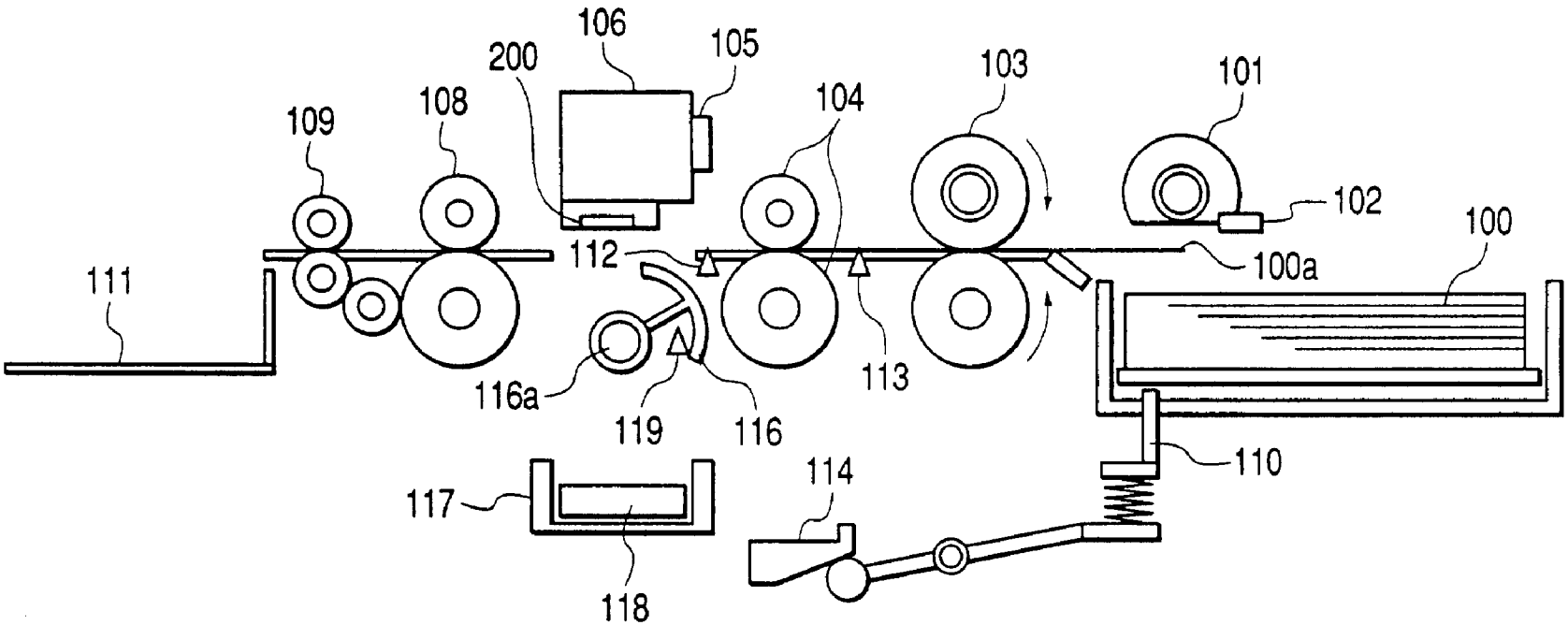
FIG. 8 is a side view which illustrates the state when the color ink jet recording apparatus performs the correction process of oblique conveyance of a recording medium in accordance with the embodiment of the present invention.

FIG. 8 shows the state in which the recording medium 100*a* is being conveyed in the direction toward the recording position, while correcting the oblique conveyance thereof.

The oblique conveyance roller 103 is installed with an inclination at an angle of several degrees in order to correct the oblique conveyance of the recording medium 100*a*. For the present embodiment, it is installed with an inclination of approximately 5°. Here, the oblique conveyance roller 103 rotates to convey the recording medium 100*a*. The rotations of the conveyance rollers 104, 108 and 109 are not driven during the period from the time at which the oblique conveyance sensor 113 has detected the leading edge of the recording medium 100*a* until a predetermined time elapses, thus enabling the leading edge of the recording medium 100*a* to be pressed to the conveyance roller 104. In this manner, the feeding by means of the oblique conveyance roller 103 is allowed to slip for the correction of the oblique conveyance of the recording medium 100*a*.

Figure 9:
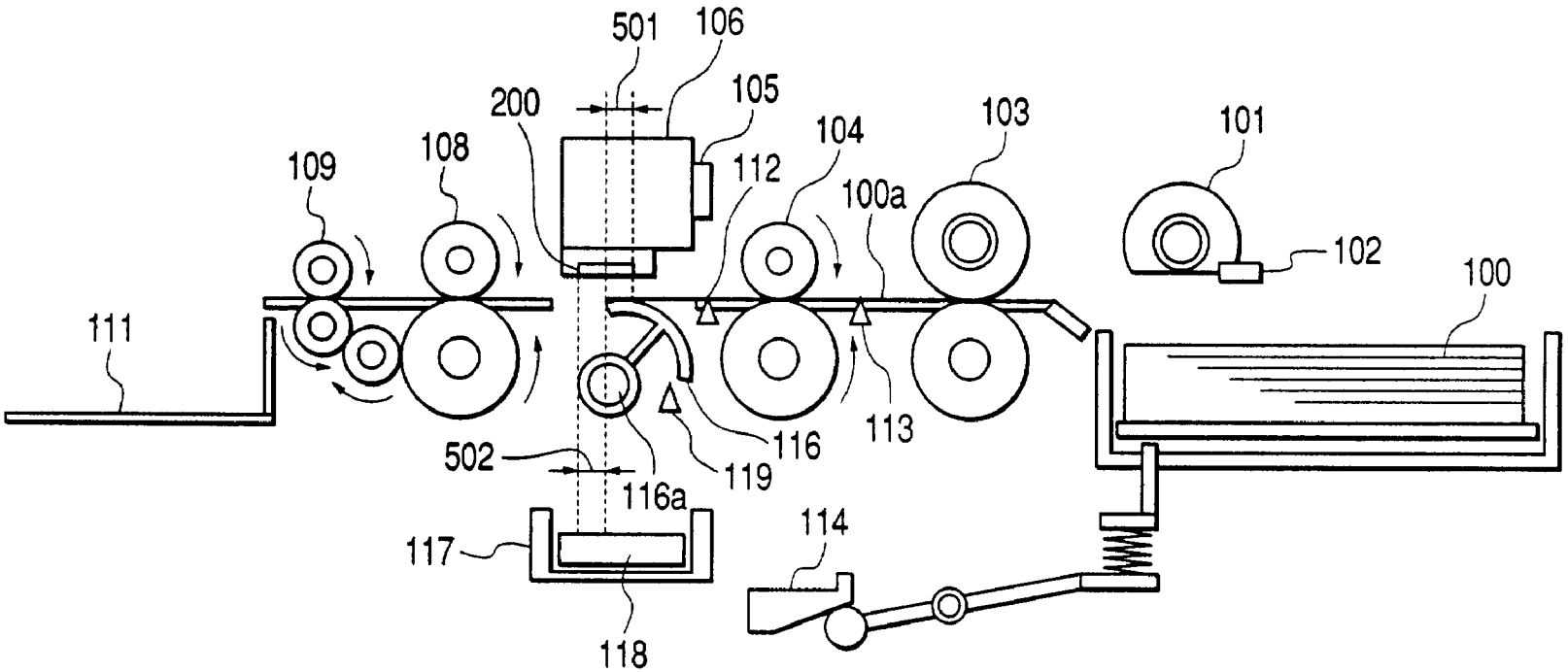
FIG. 9 is a side view which illustrates the state when the color ink jet recording apparatus performs the recording process on the leading edge of a recording medium in accordance with the embodiment of the present invention.

FIG. 9 shows the recording operation in which no margin is made on the leading edge of the recording medium 100*a*.

Subsequent to the correction of the oblique conveyance of the recording medium 100*a*, the conveyance rollers 104, 108, and 109 are rotated to convey the recording medium 100*a*. Now, when the leading edge of the recording medium 100*a* is detected by the conveyance sensor 112, the partitioning platen 116 rotates counterclockwise only in a small amount in synchronism with the rotation of the conveyance roller 104 as shown in FIG. 9. Thus, the leading edge of the recording medium 100*a* is conveyed to the recording position of the first scanning, and the partitioning platen 116 is positioned as shown in FIG. 9.

The state shown in FIG. 9 represents the recording position of the first no margin scanning of the recording medium 100*a*. In this state, the partitioning platen 116 is positioned in a hidden location underneath the recording medium 110*a*, observed from the recording head 200 side. In this state, ink is discharged from the recording head 200 to perform the first scan recording, ink is discharged onto the recording medium 100*a* from the nozzles on the upstream side 501 of the recording head 200. Then, ink from the nozzles on the downstream side 502 is discharged outside the recording medium 100*a*. In this case, ink discharged outside the recording medium 100*a* drops into the ink reception dish 117, which is absorbed by the ink absorbent 118. In this manner, it becomes possible to perform no margin recording on the leading edge of the recording medium 110*a* without staining the platen 116.

Figure 10:
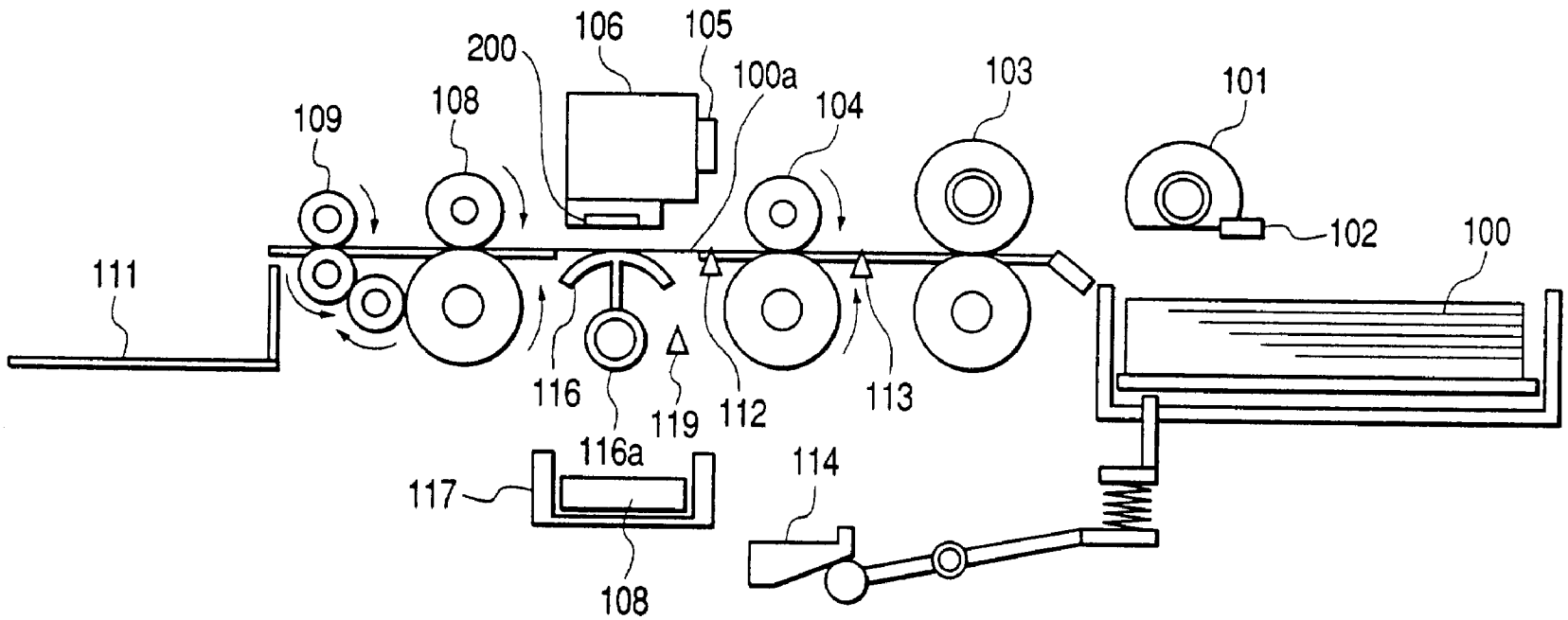
FIG. 10 is a side view which illustrates the state when the color ink jet recording apparatus performs the intervening process of recording on a recording medium in accordance with the embodiment of the present invention.

FIG. 10 shows the state in which recording is made on the intervening portion (those other than the leading edge and near the trailing edge) of the recording medium 100*a*.

Here, the partitioning platen 116 further rotates counterclockwise in synchronism with the detection of the conveyance sensor 112. When the partitioning platen 116 arrives at the position directly below the recording head 200, the rotation of the partitioning platen 116 is suspended. FIG. 10 shows the state where the rotation of the partitioning platen 116 is suspended directly below the recording head 200. In this state, recording is made on the intervening portion of the recording medium 100*a*.

Figure 11:
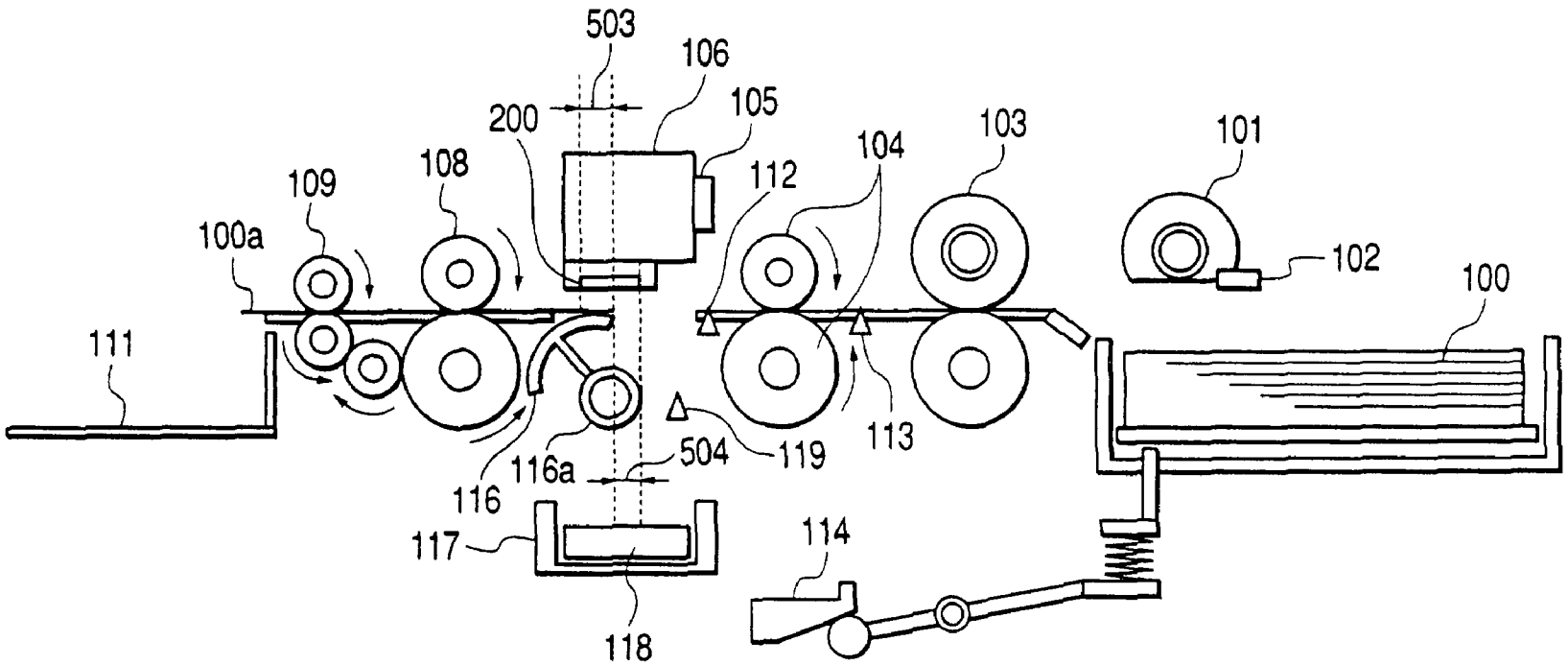
FIG. 11 is a side view which illustrates the state when the color ink jet recording apparatus performs no margin recording process on the trailing edge of a recording medium in accordance with the embodiment of the present invention.

FIG. 11 shows the state in which the recording process is executed as in FIG. 10, and then, lastly, recording is made on the vicinity of the trailing edge of the recording medium 100*a* without any margin.

During the operation of recording on the intervening portion of the recording medium 100*a* shown in FIG. 10, the partitioning platen 116 rotates in synchronism with the operation of the conveyance roller 108 from the time when the conveyance sensor 112 detects the trailing edge of the recording medium 100*a*. FIG. 11 shows the position of the recording medium 100*a* on which the last scan recording is made, and that of the partitioning platen 116. In this state, the partitioning platen 116 is positioned on the hidden location below the recording medium 100*a*, observed from the recording head 200. In this state, when ink is discharged from the recording head 200 to perform the last scan recording, ink from the nozzles of the recording head on the downstream 503 side is discharged onto the recording medium 100*a*, and ink from the nozzles on the upstream 504 side is discharged outside the recording medium 100*a*. Ink thus discharged outside the recording medium 100*a* drops into the ink receptacle dish 117, which is absorbed by the ink absorbent 118. In this manner, it becomes possible to perform no margin recording on the trailing edge of the recording medium 100*a* without staining the platen 116.

Figure 12:
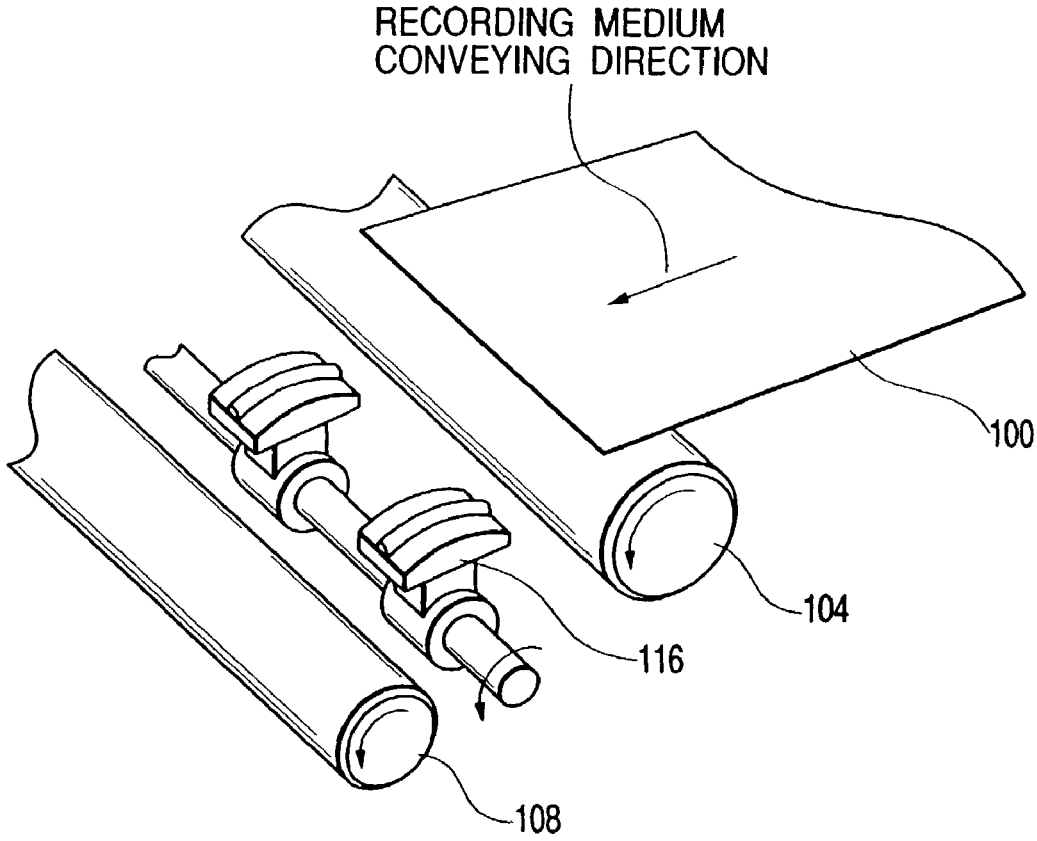
FIG. 12 is a perspective view which illustrates the platen configuration in accordance with the embodiment of the present invention.

FIG. 12 is a perspective view which illustrates the configuration of the platen embodying the present invention, which shows the state of the platen 116 when recording is made on the intervening portion (other than the leading edge, and near the trailing edge) of a recording medium. Here, the recording medium 100 shown in FIG. 12 is the one represented to illustrate the conveying direction of a recording medium, and it is not related to the phase of the platen 116.

Figure 13:
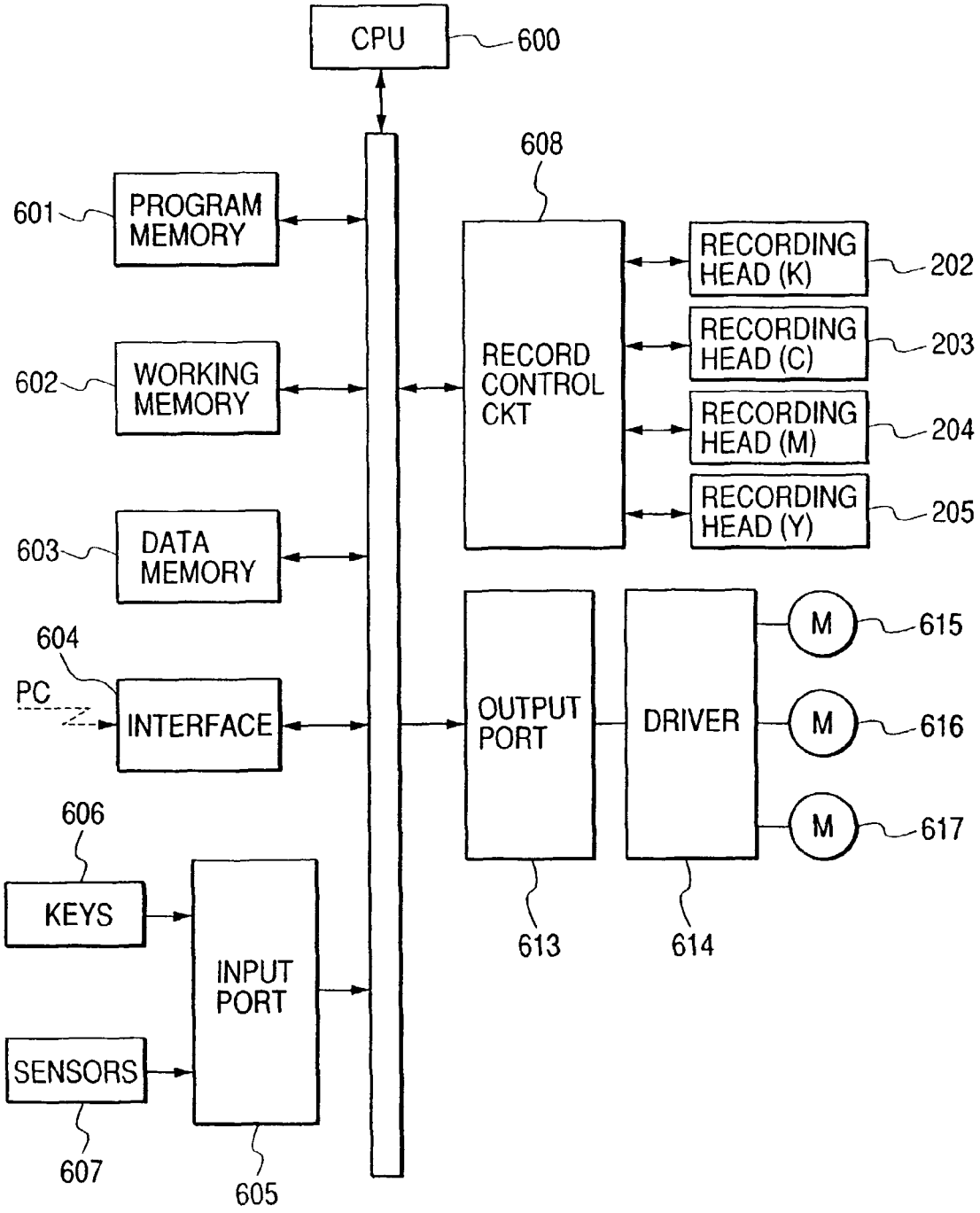
FIG. 13 is a block diagram which shows the structure of the color ink jet recording apparatus in accordance with the embodiment of the present invention.

FIG. 13 is a block diagram which shows the structure of a color ink jet recording apparatus embodying the present invention.

In FIG. 13, a reference numeral 600 designates a CPU that controls the operation of the ink jet recording apparatus as a whole in accordance with the control program which is stored on a program memory 601; 602, a working memory (RAM) that provisionally stores various data when the CPU 600 executes its control operation; 603, a data memory that stores the image data inputted from an external equipment (such as PC) through an interface 604, and at the same time, it stores the result of conversion into the recording data for driving the recording head 200; 605, an input port which receives the signals from various operation keys 606 on an operation panel (not shown), and the various sensors 102, 112, 113, 119, etc.; other; 608, a recording control circuit to drive the heads 202 to 205 of the recording head 200, which correspond to each of colors, for recording in accordance with the recording data inputted under the control of the CPU 600; 615, a carriage motor that drives the recording head 200 to scan; 616, a motor for use of conveyance to drive various rollers to rotate for conveying a recording medium; and 617, a motor that drives the partitioning platen 116 to rotate. Also, besides these motors, there are provided a motor for use of recovery process of the recording head 200, a motor for use of paper feeding, and the like. Here, it may be possible to use these motors for plural purposes by way of clutching means or the like. In such case, the number of motors can be made smaller. Here, a reference numeral 613 designates an output port through which signals are output from the CPU 600 to drive motors, and 614, drivers that drive each of the motors to rotate in accordance with the signals output from the output port 613.

Figure 14:
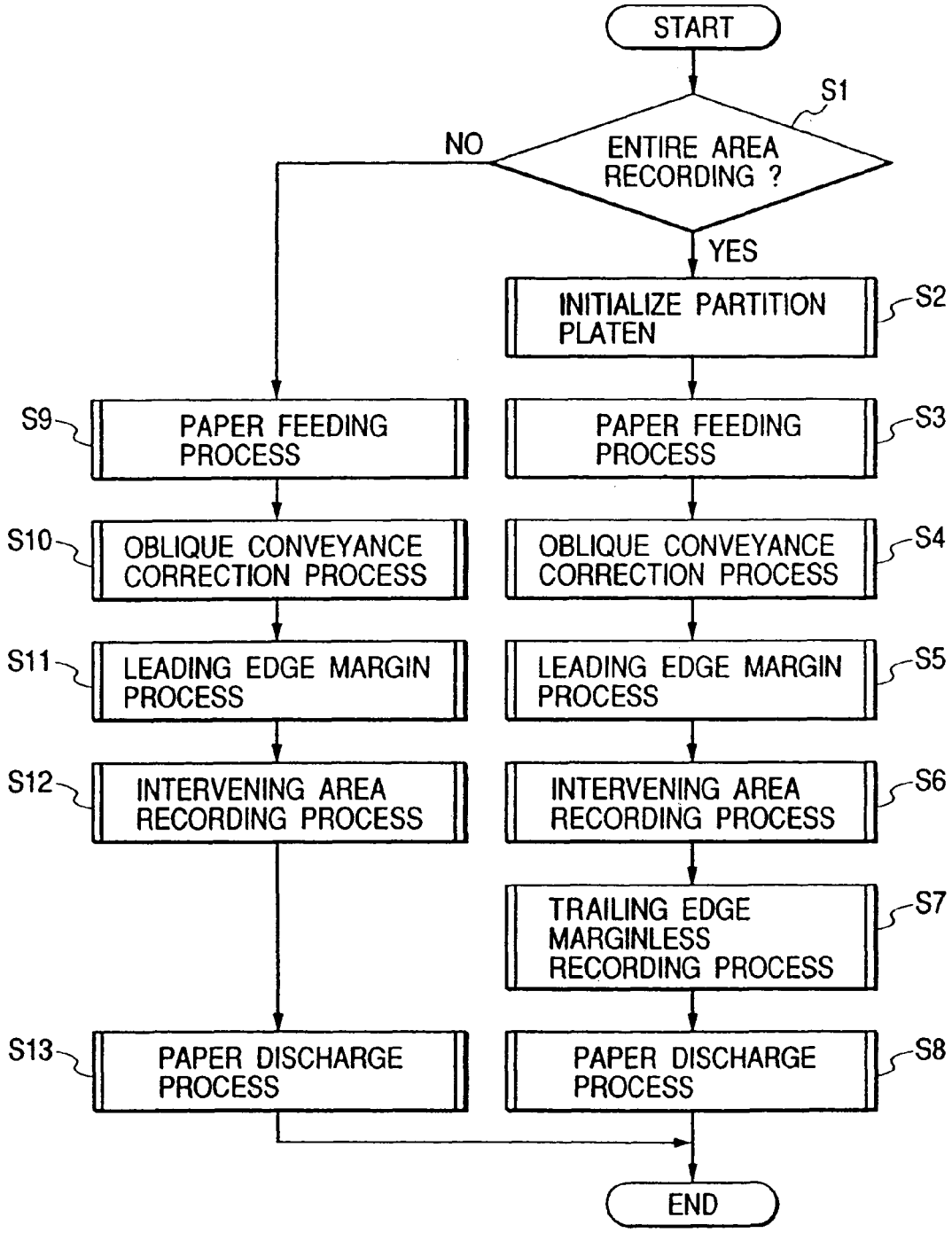
FIG. 14 is a flowchart which shows the recording process of the color ink jet recording apparatus in accordance with the embodiment of the present invention.

FIG. 14 is a flowchart which shows the recording process of a color ink jet recording apparatus embodying the present invention. The program that executes this process is stored on a program memory 601.

With a recording start command issued by the PC or the like which is connected through the interface 604, this process begins. At first, in step S1, it is determined whether an enter surface recording (recording without margins on the edges of a recording medium) is instructed or an ordinary recording is instructed. If the instruction is for the ordinary recording, the partitioning platen 116 is not actuated for recording. If the instruction is for the entire area recording, the partitioning platen 116 is actuated for recording as before described. Thus, for the ordinary recording, it is possible to record at higher speed than the entire area recording, because the partitioning platen 116 is not in operation.

Now, hereunder, the description will be made in detail. In the case of the entire area recording, the process proceeds from the step S1 to step S2 in which the partitioning platen 116 rotates and stops at the position where the home position sensor 119 can detect the position of the platen for the initialization thereof (see FIG. 9). Then, in step S3, the hopper arm 110 is raised to enable the paper feed roller 101 to rotate for paper feeding (see FIG. 6). In step S4, the oblique conveyance is corrected for the recording medium 100 thus fed (see FIG. 7 and FIG. 8). Then, proceeding to step S5, the process is made to execute the marginal processing on the leading edge of the recording medium which has been conveyed to the recording position (see FIG. 9). Now, in step S6, recording is performed on the portion other than the edges of the recording medium thus conveyed to the recording position (see FIG. 10). In step S7, no margin recording is made on the trailing edge of the recording medium (see FIG. 11). After recording is completed, the recording medium is discharged by the rotations of the paper discharge rollers 108 and 109.

On the other hand, if it is not determined in the step S1 to execute the entire area recording, the process proceeds to step S9 to make the same paper feeding processing as in the step S3. Thereafter, the oblique conveyance correction, the marginal processing on the leading edge of the recording medium, and the intervening recording process on the recording medium are executed in step S10 to step S12 as in the step 4 to the step 6 as before described. Then, in step S13, the recording medium is discharged after the completion of recording.

Hereinafter, the description will be made of each step with reference to flowcharts shown in FIG. 15 to FIG. 21.

Figure 15:
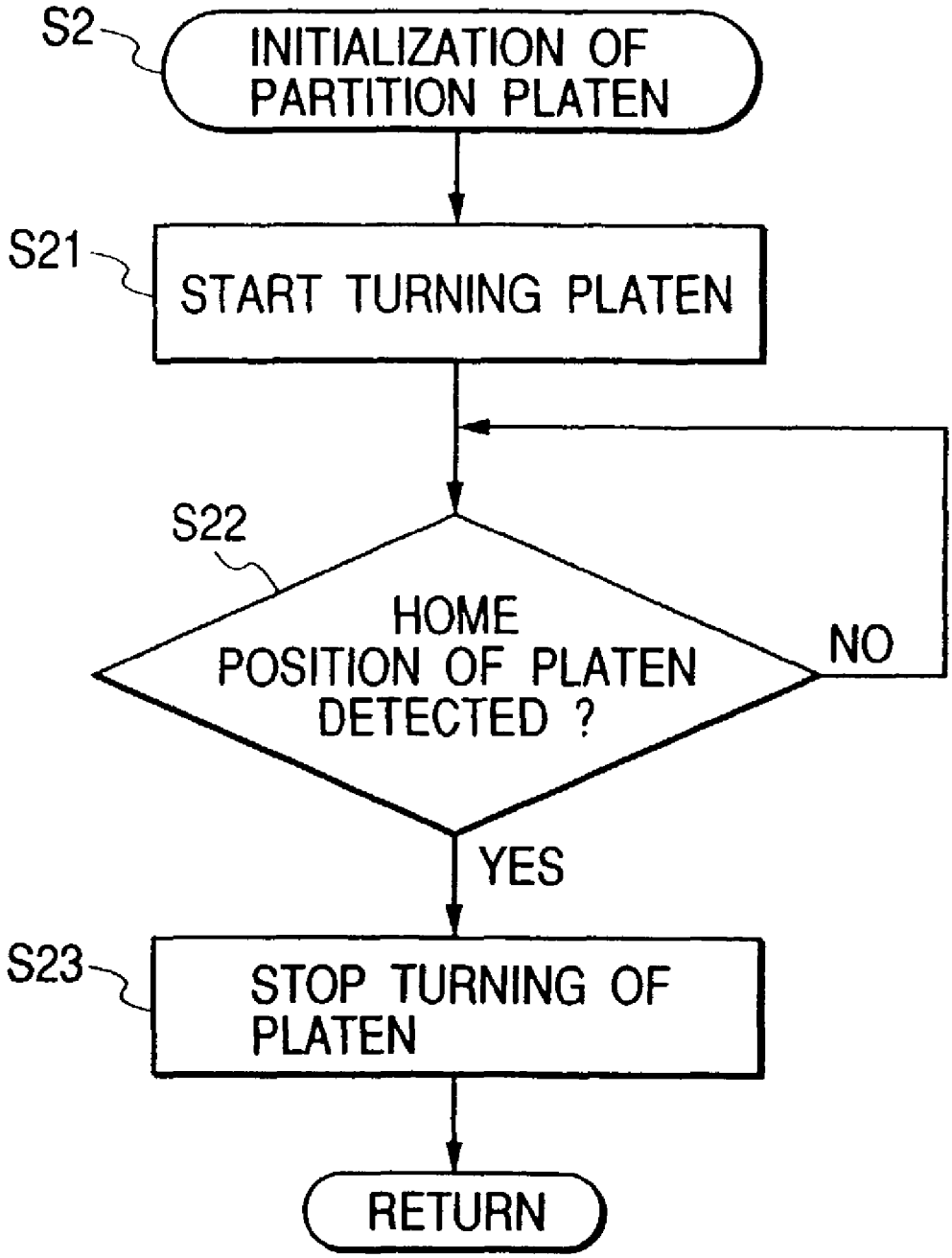
FIG. 15 is a flowchart which shows the initiation process of the platen partition in the step S2 represented in FIG. 14.

FIG. 15 is a flowchart which shows the process to initialize the position of the partitioning platen 116 in the step S2 represented in FIG. 14.

At first in step S21, the motor 617 is driven to rotate so that the shaft 116*a* rotates in the clockwise direction. Then, in step S22, it is examined whether or not the home position sensor 119 has detected the partitioning platen 116. If affirmative, the rotation of the motor 617 is suspended to indicate that the platen 116 has arrived at the home position (see FIG. 5), thus completing the initialization process to position the platen 116.

Figure 16:
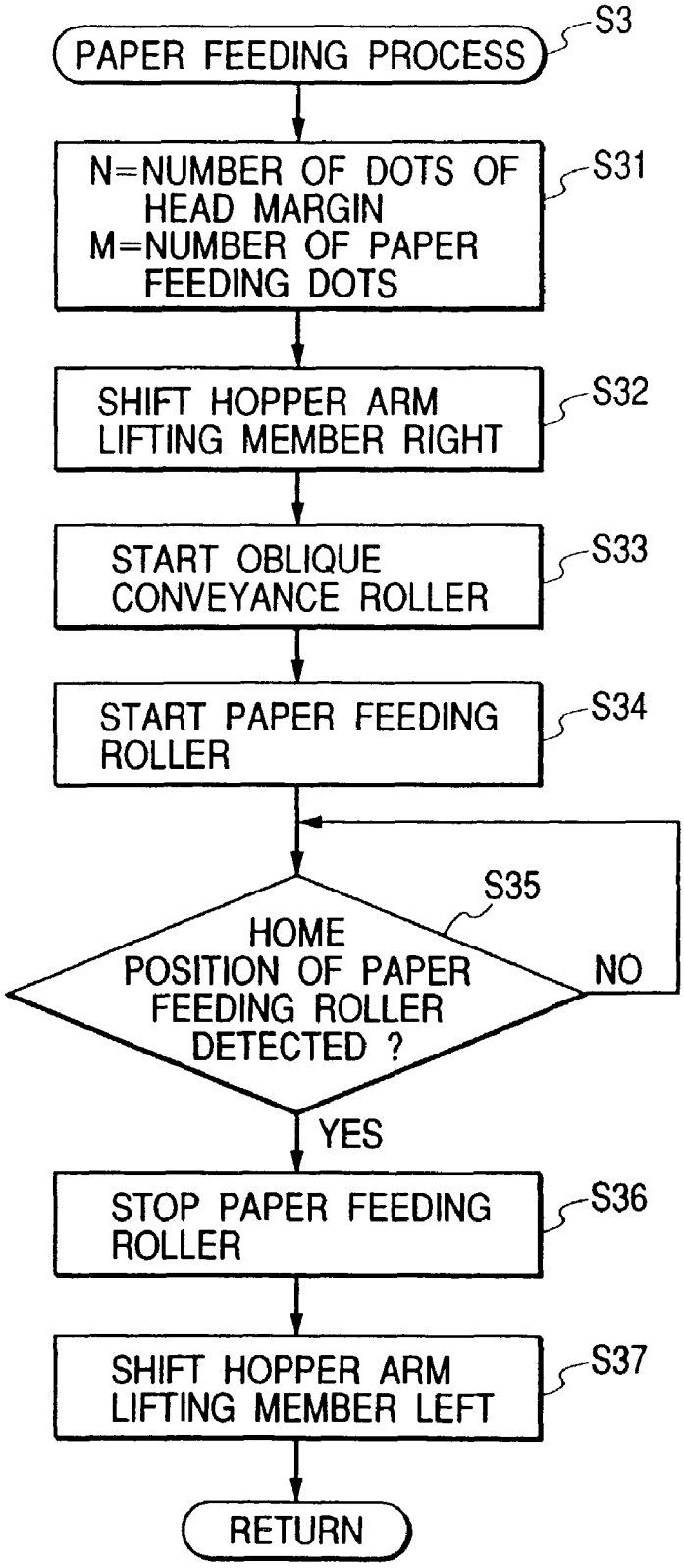
FIG. 16 is a flowchart which shows the paper feeding process in the step S3 represented in FIG. 14.

FIG. 16 is a flowchart which shows the paper feeding process of the recording medium 100 (step S3).

At first in step S31, the numbers of dots (N) on the upper margin of the recording medium and the numbers of dots (M) needed for conveying paper sheet are set. Then, proceeding to step S32, the process shifts the member 114 in the right direction in FIG. 6 in order to raise the hopper arm 110. In this way, the paper sheet cassette that contains recording mediums 100 rises as shown in FIG. 6. Then, in step S34, the paper feed roller 101 begins to rotate. Thus, the uppermost recording medium 100*a* is fed toward the oblique conveyance roller 103. In step S35, it is examined by use of the home position sensor 102 of the paper feed roller 101 whether or not the rotation of the paper feed roller 101 is in the home position. If the roller arrives at the home position, the process proceeds to step S36 where the rotation of the paper feed roller 101 is suspended. Then, in step S37, the member 114 for raising the hopper arm 110 shifts in the left direction in FIG. 6 to allow the cassette to descend.

Figure 17:
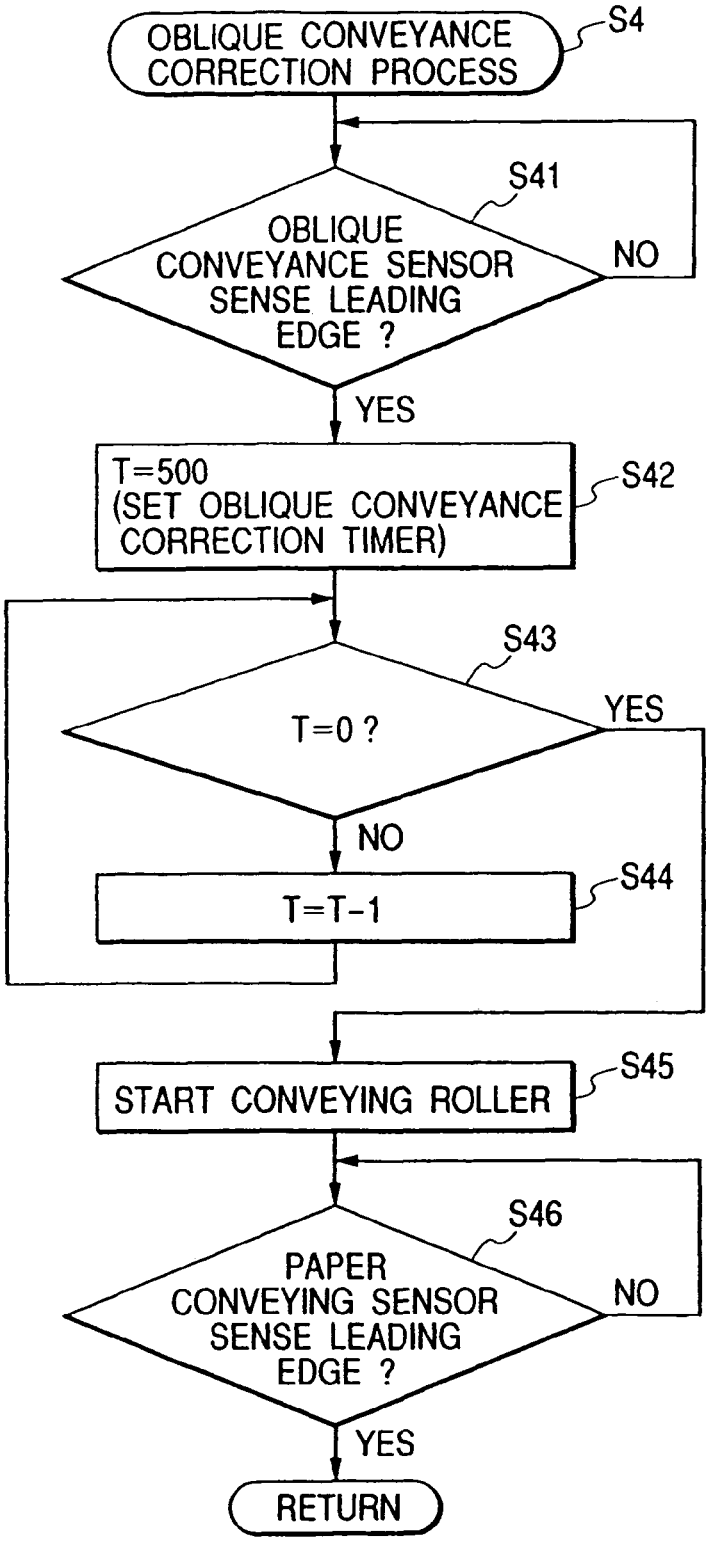
FIG. 17 is a flowchart which shows the correction process of the oblique conveyance in the step S4 represented in FIG. 14.

FIG. 17 is a flowchart which shows the oblique conveyance correction process in the step 4 in FIG. 14.

At first, in step S41, it is examined whether or not the leading edge of the recording medium is detected by the oblique conveyance sensor 113. If affirmative, the process proceeds to step S42 where T=500 is set as the timer value for use of the oblique conveyance correction. Then, proceeding to step S43, the process waits until the predetermined time elapses, which corresponds to T=500 thus set. During this period, the leading edge of the recording medium, which has been conveyed by the oblique conveyance roller 103, abuts against the conveyance roller 104 to correct the oblique conveyance. When the predetermined time has elapsed, the process proceeds to step S45 where the conveyance roller 104 begins to rotate, thus initiating the conveyance of the recording medium, the oblique conveyance of which has been corrected. Then, in step S46, it is examined whether or not the leading edge of the recording medium is detected by the conveyance sensor 112. If affirmative, the oblique conveyance correction process is completed.

Figure 18:
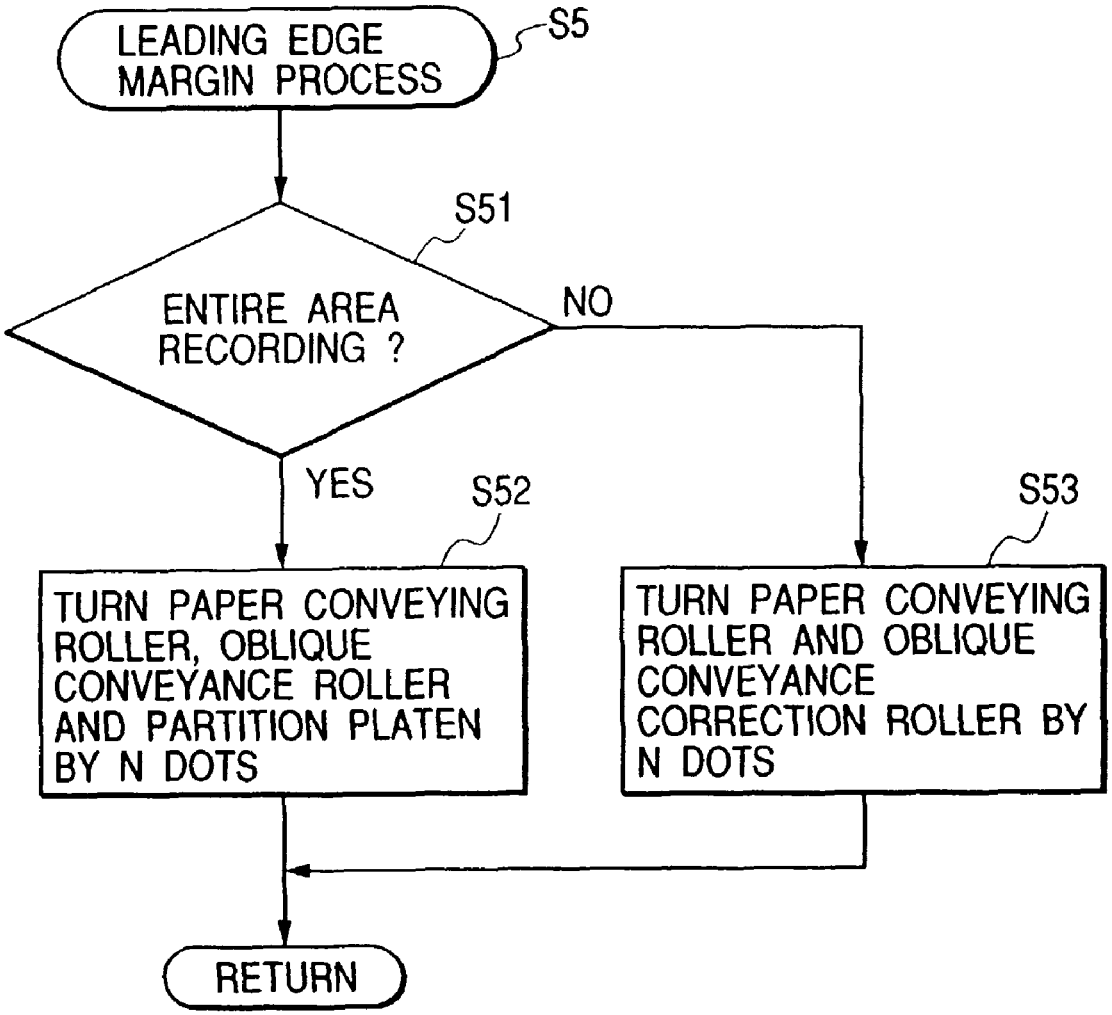
FIG. 18 is a flowchart which shows the marginal process on the leading edge of the recording medium in the step S5 represented in FIG. 14.

FIG. 18 is a flowchart which shows the leading edge marginal process of the recording medium in the step S5 in FIG. 14.

Here, the process is executed to set a margin on the leading edge of the recording medium. At first, in step S51, it is examined whether or not the entire area recording is instructed. If affirmative, the process proceeds to step S52 where the conveyance roller 104, the oblique conveyance roller 103, and the partitioning platen 116 rotate by the N-dot amount which corresponds to the margin to be set on the leading edge of the recording medium. If negative, on the other hand, the process proceeds to step S53 where the conveyance roller 104 and the oblique conveyance roller 103 rotate by the N-dot amount which corresponds to the margin on the leading edge thereof.

In this way, the partitioning platen 116 is not rotated if the process is not to execute the entire area recording.

Figure 19:
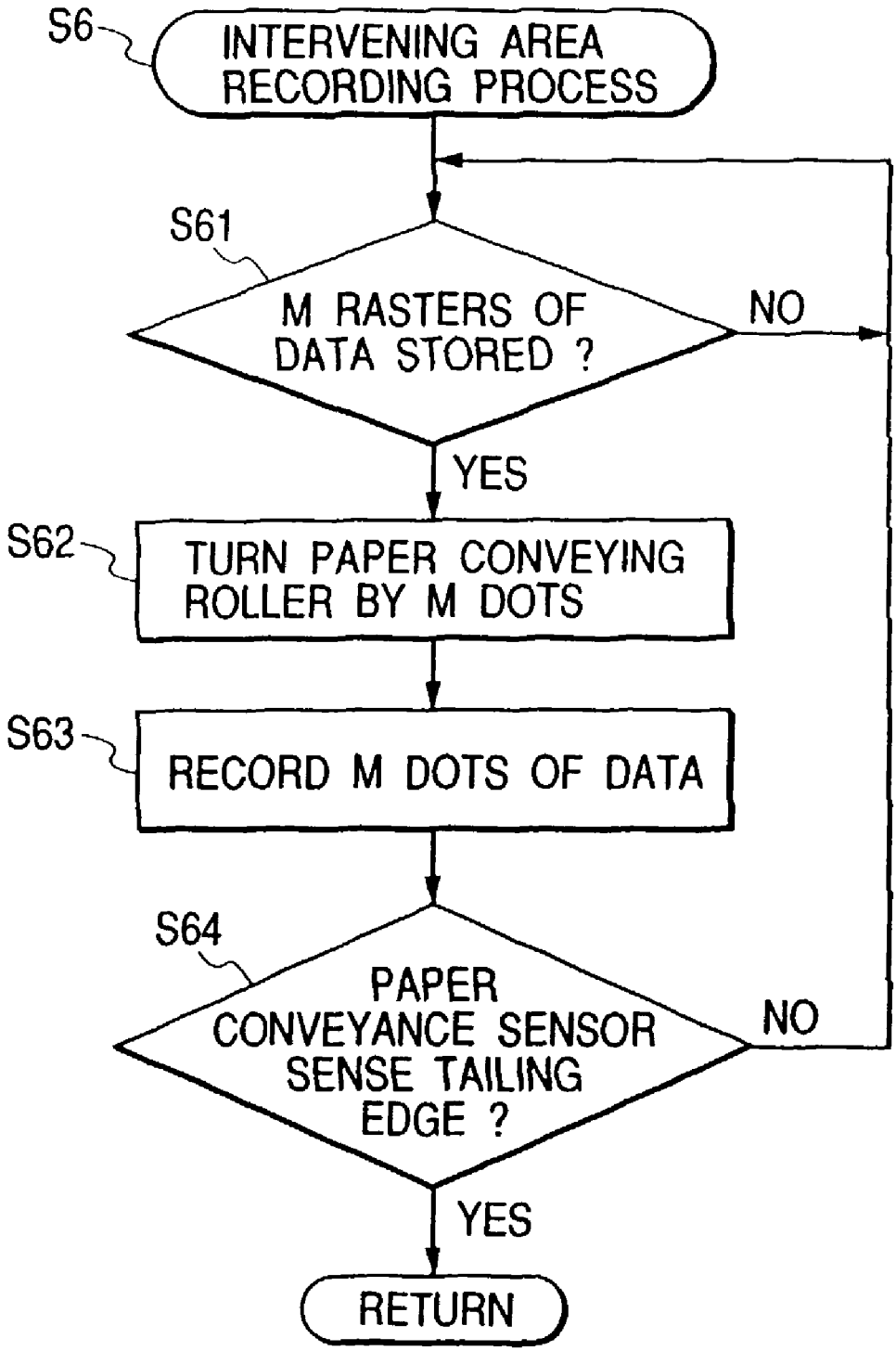
FIG. 19 is a flowchart which shows the intervening recording process of the recording medium in the step S6 represented in FIG. 14.

FIG. 19 is a flowchart which shows the recording process (see FIG. 10) on the intervening portion of the recording medium in the step S6 in FIG. 14. This is the same as the normal recording process.

At first, in step S61, it is examined whether or not the recording data of M-raster amount are stored on the data memory 603. If affirmative, the process proceeds to step S62 where the conveyance rollers 104 and 108 rotate so that the recording medium is conveyed in a length corresponding to the M-dot portion (the numbers of the conveyance dots of the recording medium). Then, in step S63, the recording data of the M-raster portion are output to the recording head 200 through the recording control circuit 608 for recording. Then, proceeding to step S64, the process executes the step S61 to the step S64 until the conveyance sensor 112 detects the trailing edge of the recording medium. Thus, when the trailing edge of the recording medium is detected by the sensor 112, the recording process on the intervening portion of the recording medium is completed, and the process proceeds to the step S7 where no margin recording process is executed on the trailing edge of the recording medium.

Figure 20:
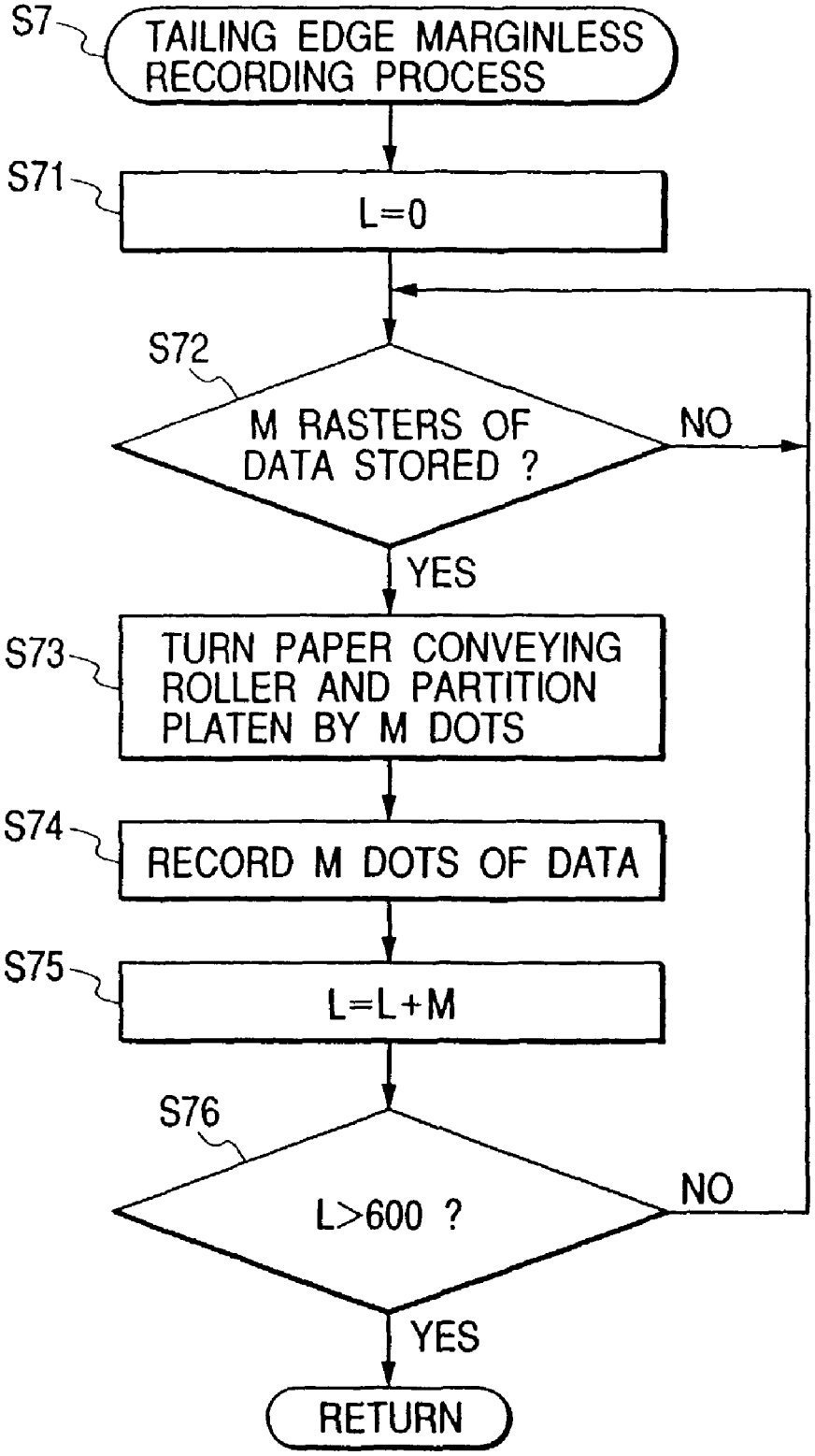
FIG. 20 is a flowchart which shows no margin recording process on the trailing edge of the recording medium in the step S7 represented in FIG. 14.

FIG. 20 is a flowchart which shows no margin recording process on the trailing edge of the recording medium in the step S7 in FIG. 14.

At first, in step S71, a variable L is initialized at "0" to determine whether or not there has been completed the recording of a length corresponding to the marginal portion on the trailing edge of the recording medium. Then, proceeding to step S72, the process makes an examination of whether or not the recording data of M-raster portions are stored on the data memory 603 as in the step S61 in FIG. 19. If affirmative, the process proceeds to step S73 where the conveyance rollers 108 and 109, and the partitioning platen 116 rotate by the M-dot amount. Thus, the platen 116 rotates following the advancement of the recording medium. Therefore, the platen remains hidden behind the recording medium all the time, as observed from the recording head 200 (see FIG. 11). Then, in step S74, recording is made by the M-dot amount. Next, the process proceeds to step S75 where the "M" of M dots thus recorded is added to the variable L, and in step S76, the aforesaid step S72 to step S76 are executed until this value exceeds "600" that is, until the trailing edge of the recording medium is parted from the recording position of the recording head 200.

In this way, it is possible to record images on the trailing edge of the recording medium without margin.

Figure 21:
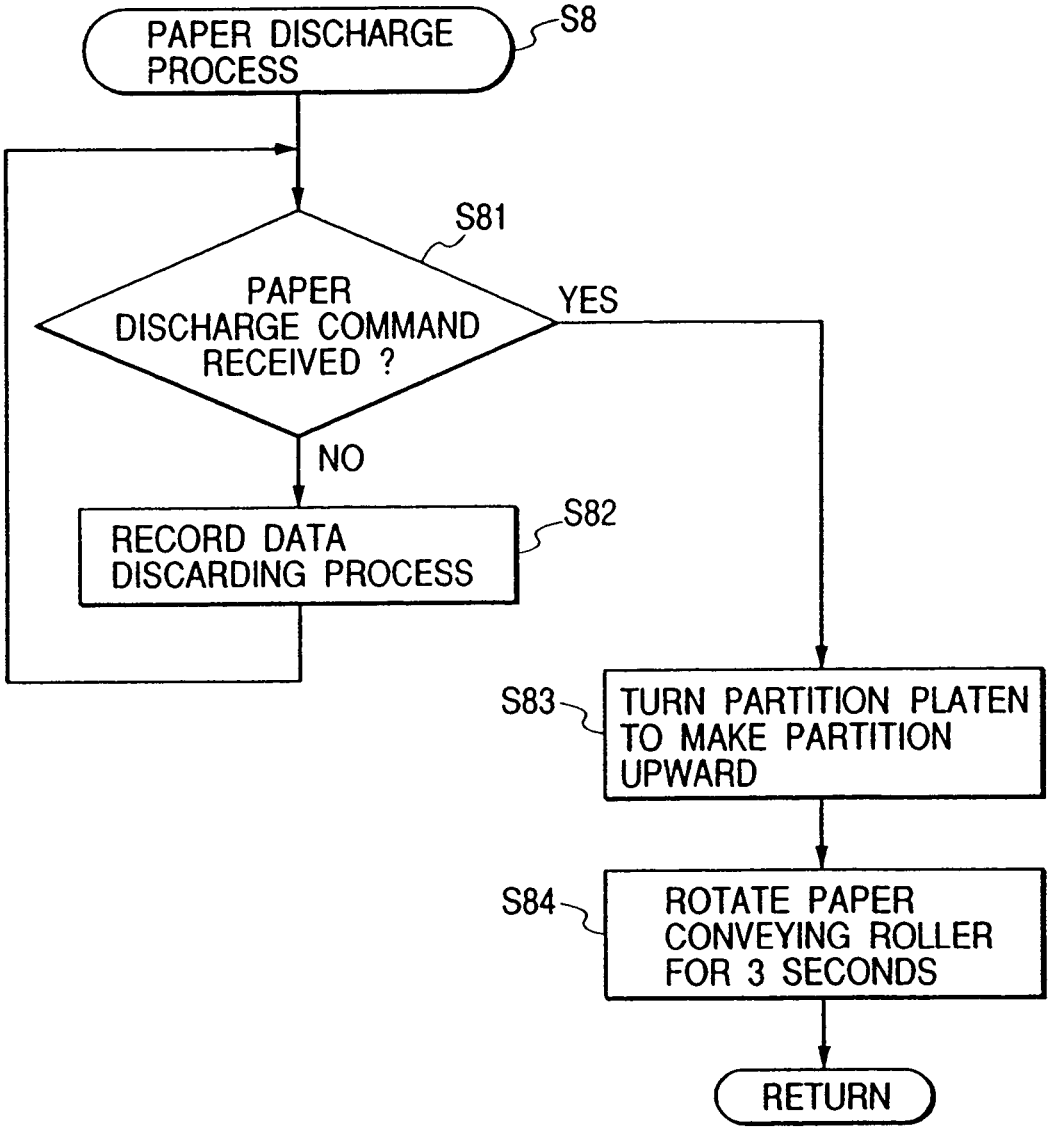
FIG. 21 is a flowchart which shows the paper discharge process of the recording medium in the step S8 represented in FIG. 14.

FIG. 21 is a flowchart which shows the paper discharge process of the recording medium after recording in the step S8 in FIG. 14.

In step S81, it is examined whether or not the paper discharge command is received through the interface 604. If negative, the process proceeds to step S82 where the reading of recording data is discarded, because no recording is possible any longer.

Then, if affirmative, the process proceeds to step S83 where the partitioning plate 116 rotates in the clockwise direction until its partitioning surface comes up. Thus, proceeding to step S84, the process executes the continuous rotation of the conveyance rollers 108 and 109 for a period of three seconds. In this manner, the recording medium after recording is discharged onto the tray 111.

In accordance with the first embodiment that has been described above, it is possible to record images on a recording medium without margins.

Second Embodiment

For the first embodiment described above, the intervals between partitions of the partitioning platen 116 are fixed, but for the present embodiment, the intervals are made manually changeable.

Figure 22A:
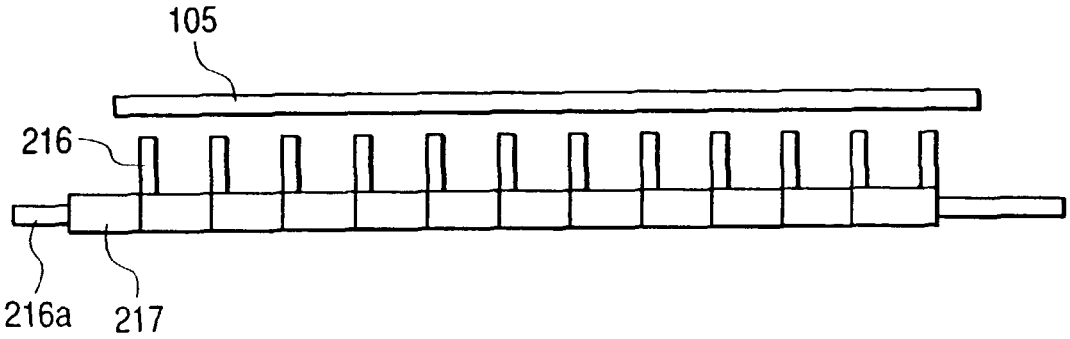
FIGS. 22A and 22B are views which illustrate the partitioning platen of an ink jet recording apparatus in accordance with a second embodiment of the present invention.
Figure 22B:
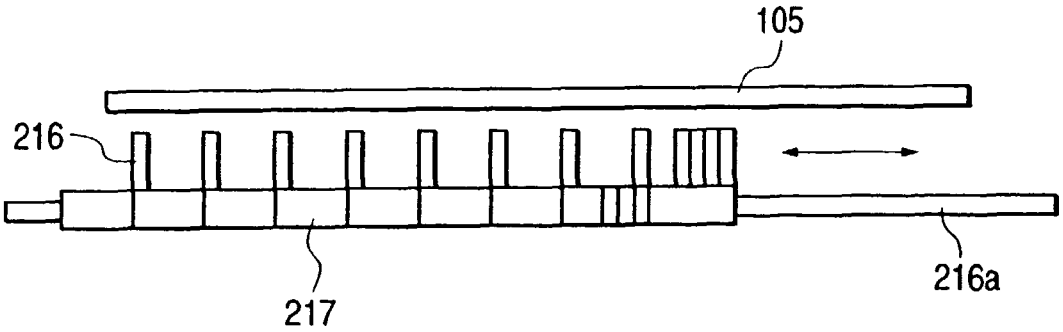

FIGS. 22A and 22B are views which illustrate the structure of a partitioning platen 216 in accordance with a second embodiment of the present invention. Here, a reference numeral 105 designates a belt.

For the present embodiment, a plurality of cylindrical members 217 are arranged, each with a partition of the platen 216. The cylindrical members 217 are made manually slidable on a platen shaft 216*a* so that the positions of the partitions can be changed from the status shown in FIG. 22A to the one shown in FIG. 22B. As a result, the entire area recording is possible not only on a recording medium in a fixed size, but also, on the one in any size by manually shifting the partitions of the platen 216 in accordance with the size of a recording medium to be used for recording.

Third Embodiment

Now, in accordance with the second embodiment described above, the partitions of the platen 216 are made manually movable, but for a third embodiment here, the partitions are made automatically movable.

When a recording method and the size of a recording medium are received from PC or the like as commands, the recording method is determined for use of the recording medium in accordance with such command for recording, and at the same time, the partitions of the partitioning platen 216 are automatically moved to be in agreement with the size of the recording medium which is discriminated by such command thus received. In this way, it becomes possible to match the intervals of the partitions with the size of the recording medium to be used.

Figure 23A:
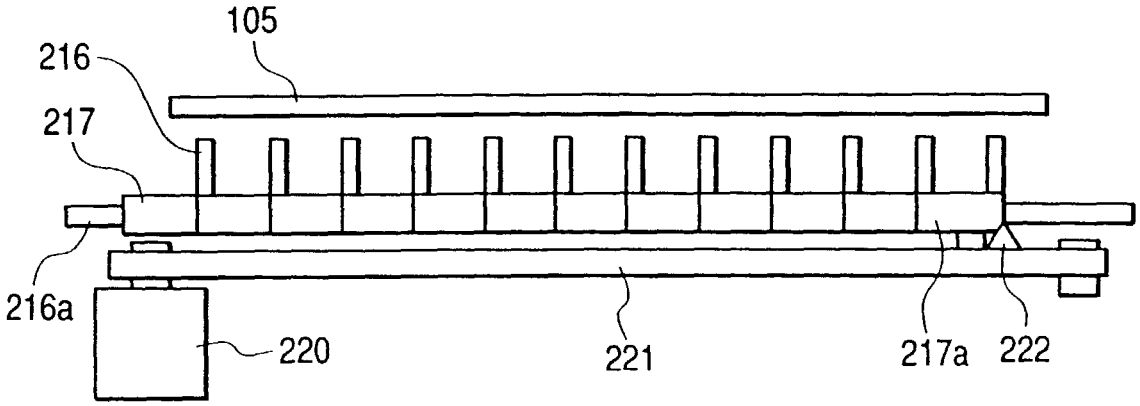
FIGS. 23A and 23B are views which illustrate the partitioning platen of an ink jet recording apparatus in accordance with a third embodiment of the present invention.
Figure 23B:
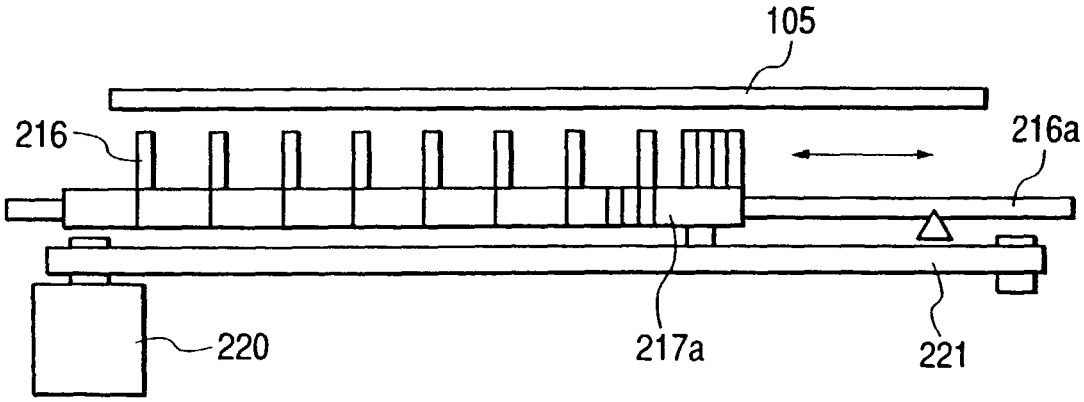

FIGS. 23A and 23B are views which illustrate the structure of the partitioning platen in accordance with the third embodiment of the present invention.

The plurality of cylindrical members 217 are arranged each with the partition of platen 216. The members 217 are made slidable on the partitioning platen shaft 216*a*. Further, a belt 221 connected directly with a motor 220 is attached to the cylindrical member 217*a* at the furthest edge, and the positions of the partitions are made shiftable by the rotation of the motor 220. Thus, the intervals of the partitions 216 are changed from the status shown in FIG. 23A to the one shown in FIG. 23B. In this way, it becomes possible to perform the entire area recording not only on a recording medium of fixed size, but also, on a recording medium of any size by automatically adjusting the intervals of the partitions.

Figure 24:
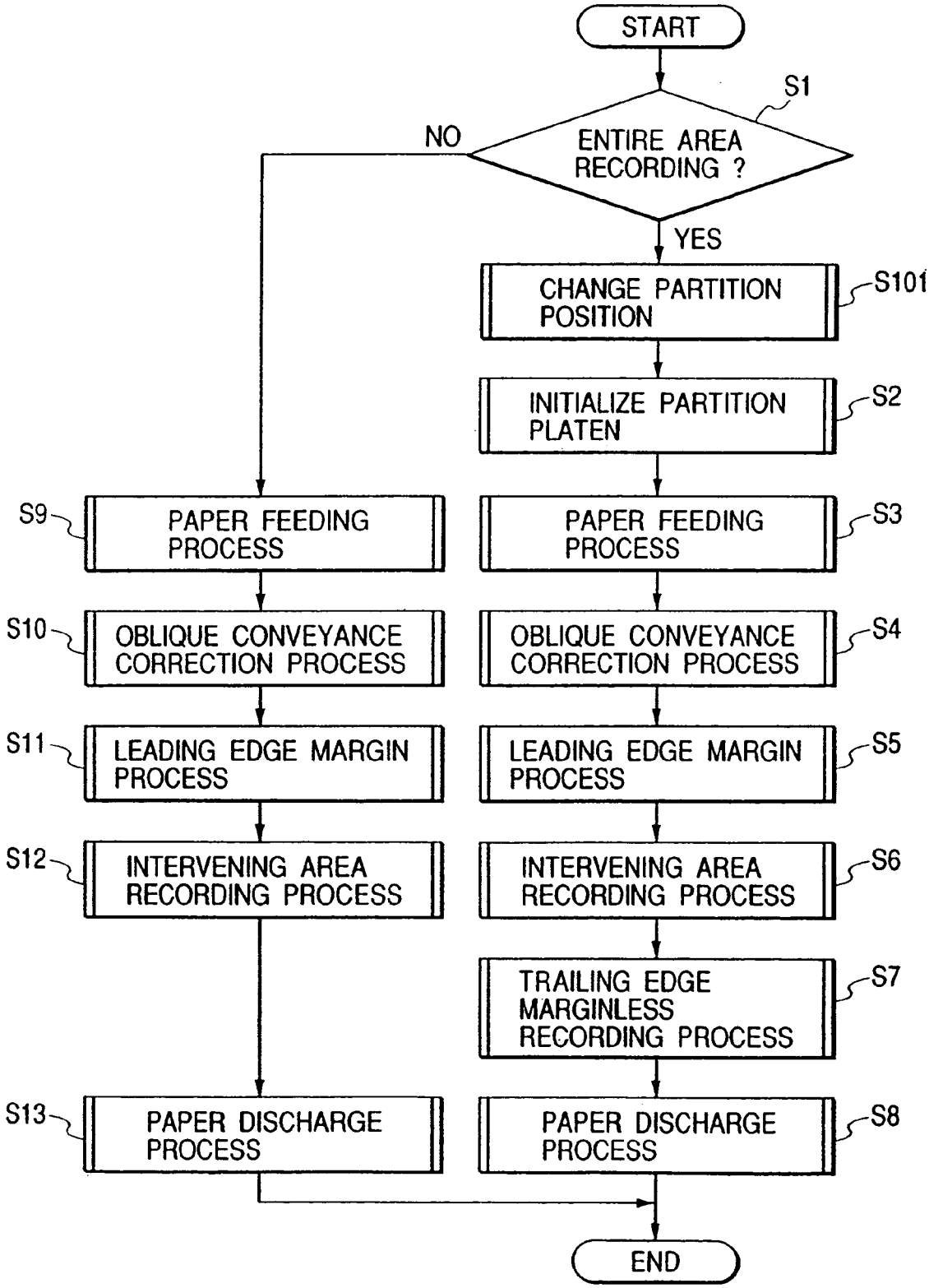
FIG. 24 is a flowchart which shows the recording process of the color ink jet recording apparatus in accordance with the third embodiment of the present invention.

FIG. 24 is a flowchart which shows the recording process by an ink jet recording apparatus in accordance with the third embodiment of the present invention. The same reference marks are applied to the sections which are shared by the processes shown in FIG. 14. The description thereof will be omitted.

Here, in step S1, the process proceeds to step S101 if an entire area recording is instructed. Then, the motor 220 is driven to rotate in accordance with the size of the recording medium to be used, and the recording mode (whether it is an entire area recording or not), thus changing the intervals of the partitions of the partitioning platen 216 to be in agreement with the size of the recording medium to be used (see FIG. 23B). Then, the aforesaid processes in the steps S2 to S8 are executed. It is therefore made possible to perform the entire area recording not only on a recording medium of fixed size or on the one of any size by automatically adjusting the intervals of the partitions accordingly.

Fourth Embodiment

In accordance with a fourth embodiment, the nipping pressure exerted on a recording medium 100*a* by the conveyance roller 104 on the entrance side is released in a state where recording is being made on the intervening portion of the recording medium 100*a*. In FIG. 10, when the conveyance of the recording medium 100*a* is suspended after the trailing edge of the recording medium 100*a* has been detected by the oblique conveyance sensor 113, the nipping pressure exerted on the recording medium 100*a* by the conveyance roller 104 on the entrance side is released. Then, thereafter, the recording medium 100*a* is conveyed in the downstream direction (in the left direction in FIG. 10) by the rotation of the conveyance roller 108 at the same speed as has been made until then.

Now, with reference to FIGS. 25A and 25B, the description will be made of the nipping pressure releasing for a color ink jet recording apparatus in accordance with the present embodiment.

Figure 25A:
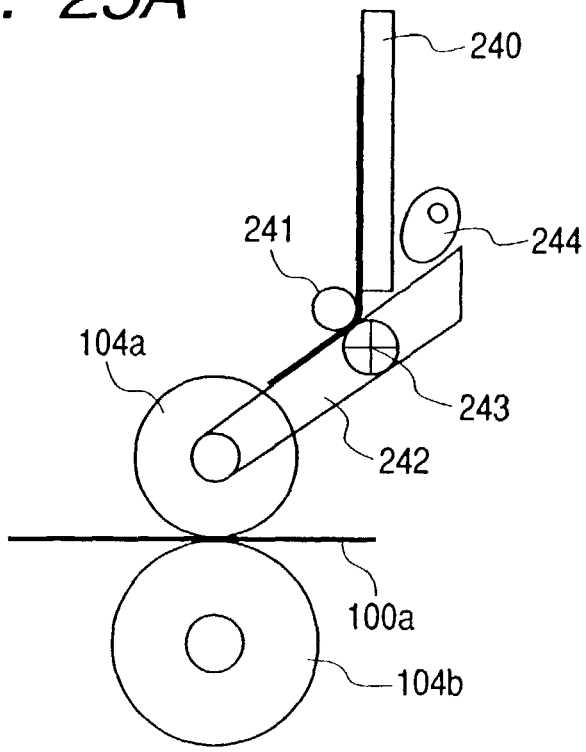
FIGS. 25A and 25B are views which illustrate the structure of a nipping pressure releasing unit in accordance with a fourth embodiment of the present invention.
Figure 25B:
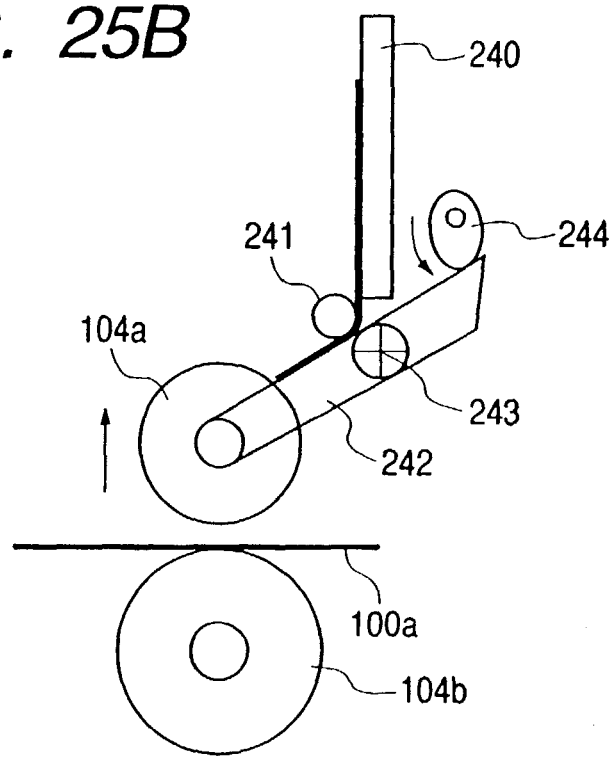

FIG. 25A is a view which shows the state of a nipping pressure releasing unit 618 of the present embodiment before nipping pressure is released. FIG. 25B is a view which shows the state thereof after nipping pressure is released.

The nipping pressure releasing unit 618 is provided with a supporting member 240, pivotable on a shaft 243 and an arm 242 having a pressure roller 104*a* rotatively fixed to the end thereof, a cam 244 engaged with the arm 242 to allow the conveyance roller 104 to part from the recording medium 100*a*, and a pressure spring 241 that biases the arm 242 so that the pressure roller 104*a* is pressed against the recording medium 100*a* between the supporting member 240 and the arm 242.

When the cam 244 rotates in the counterclockwise direction from the state shown in FIG. 25A, the arm 242 and the cam 244 engage with each other. Then, as shown in FIG. 25B, the arm 242 rotates on the shaft 243 in the clockwise direction. Thus, the pressure roller 104*a* rises to release the pressure to the recording medium 100*a*. The nipping pressure is then completely released (that is, the pressure roller 104*a* becomes free from the driving roller 104*b*).

With the structure arranged as above, it becomes possible to correct the oblique conveyance of a recording medium and/or prevent the kicking out thereof in order to convey the recording medium in precision for recording.

Fifth Embodiment

Figure 26A:
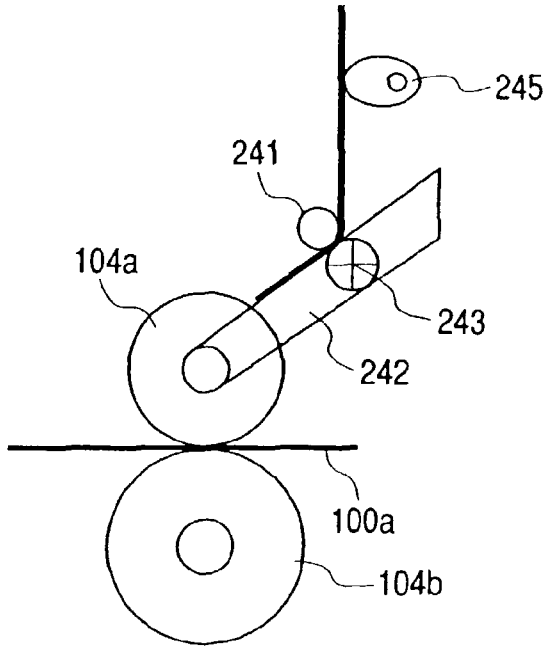
FIGS. 26A and 26B are views which illustrate the structure of a nipping pressure releasing unit in accordance with a fifth embodiment of the present invention.
Figure 26B:
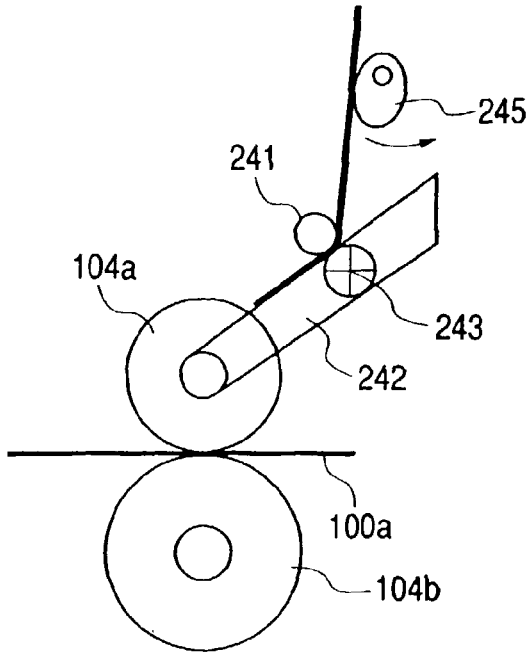

FIGS. 26A and 26B are views which illustrate another structure of the nipping pressure releasing unit 618 in accordance with a fifth embodiment of the present invention. For the fifth embodiment, the nipping pressure is released by making it weaker, not by completely releasing the nipping pressure exerted by the conveyance roller 104 on the entrance side (not making the pressure roller 104*a* completely free from the driving roller 104*b*). In this respect, the same reference numerals are applied to the parts shareably represented in FIGS. 25A and 25B.

As shown in FIG. 26A, the conveyance roller on the entrance side is provided with the pressure roller 104*a* and the driving roller 104*b*, and the pressure roller 104*a* is rotatively supported by the arm 242. As shown in FIG. 26A, when the cam 245 engages with the pressure spring 241, the arm 242 is pressed downward by means of the pressure spring 241. With this pressure, the pressure roller 104*a* is in contact with the driving roller 104*b* under a given pressure.

In this state, the cam 245 rotates in the counterclockwise direction as shown in FIG. 26B to weaken the pressure exerted by the pressure spring 241 on the pressure roller 104*a*, hence the nipping pressure of the conveyance roller 104 becoming weaker.

Sixth Embodiment

Figure 27:
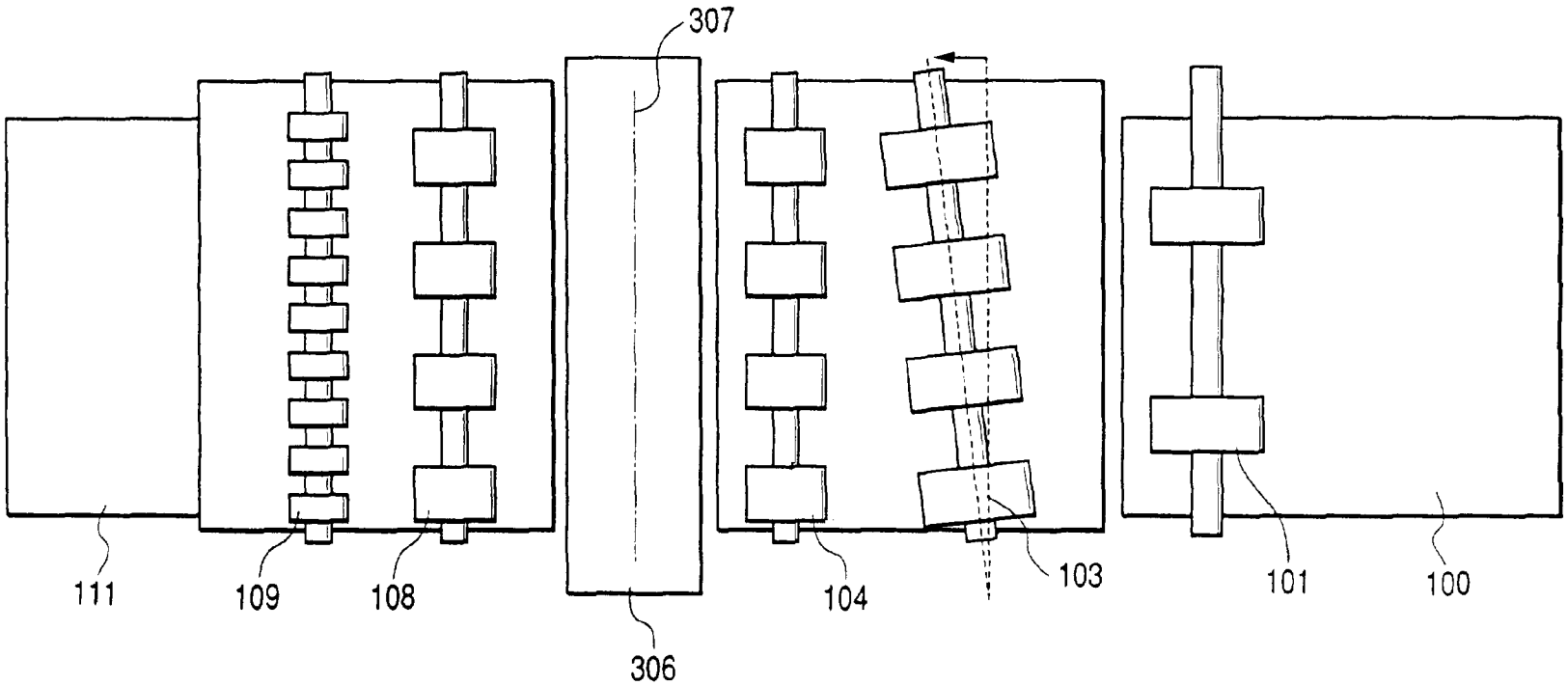
FIG. 27 is a plan view which illustrates a color ink jet recording apparatus in accordance with a sixth embodiment of the present invention.

FIG. 27 is a plan view which shows a color ink jet recording apparatus in accordance with a sixth embodiment of the present invention. The ink jet recording apparatus of the present embodiment is the so-called line head type, which is provided with the line head 306 having a nozzle array 307 for discharging ink formed on a wider area than the width of a recording medium 100 in the sub-scanning direction. The line head 306 is mounted detachably on a head installation unit (not shown). The nozzle array 307 is formed on the side where the line head 306 faces the recording medium 100. Also, the line head 306 is fixed to the main body of an ink jet recording apparatus (not shown) by use of a fixing member (not shown).

When recording is performed, images are recording in the size which is larger by one step than the size of a recording medium to be used. Here, as described earlier, the partitions of the platen are arranged each with a margin with respect to each size of the respective recording mediums to make it possible to perform no margin recording in the transverse direction without staining the partitions of the platen even if the image thus recorded is larger by one step.

The ink jet recording apparatus of the present embodiment is fundamentally the same as the one described in the first embodiment as to its structure and operation with the exception of those described above. Therefore, the detailed description thereof will be omitted.

(Other Information)

The present invention has been described using, particularly, a recording apparatus of ink jet recording method, which is provided with means for generating thermal energy (electrothermal transducing elements or laser beams, for example) as energy to be utilized for discharging ink, and which adopts a method whereby to create change of states ink using such thermal energy. With a method of the kind, it becomes possible to attain the performance of recording in high density and in high precision.

As regards the typical structure and operational principle of such method, it is preferable to adopt those implemental by the application of the fundamental principle disclosed in the specifications of U.S. Pat. Nos. 4,723,129 and 4,740,796, for example. This method is applicable to the so-called on-demand type recording and a continuous type one as well. Here, in particular, with at least one driving signal that corresponds to recording information, the on-demand type provides an abrupt temperature rise beyond nucleate boiling by each of the electrothermal transducing elements arranged for a sheet or a liquid path where liquid (ink) is retained. Then, thermal energy is generated by each of the electrothermal transducing elements, hence creating film boiling on the thermal activation surface of the recording head to effectively form resultant bubbles in liquid (ink) one to one corresponding to each of the driving signals. Then, by the development and contraction of each bubble, the liquid (ink) is discharged through each of the discharge openings, hence forming at least one droplet. The driving signal is more preferably in the form of pulses because the development and contraction of the bubble can be made instantaneously and appropriately to attain performing particularly excellent discharges of liquid (ink) in terms of the response action thereof.

The driving signal in the form of pulses is preferably such as disclosed in the specifications of U.S. Pat. Nos. 4,463,359 and 4,345,262. In this respect, the temperature increasing rate of the thermoactive surface is preferably such as disclosed in the specification of U.S. Pat. No. 4,313,124 for an excellent recording in a better condition.

As the structure of the recording head, there are included in the present invention, the structure such as disclosed in the specifications of U.S. Pat. Nos. 4,558,333 and 4,459,600 in which the thermal activation portions are arranged in a curved area, besides those which are shown in each of the above-mentioned specifications wherein the structure is arranged to combine the discharging openings, liquid paths, and the electrothermal transducing devices (linear type liquid paths or right-angled liquid paths). In addition, the present invention is effectively applicable to the structure disclosed in Japanese Laid-Open Application No. 59-123670 wherein a common slit is used as the discharging openings for plural electrothermal transducing devices, and to the structure disclosed in Japanese Patent Laid-Open Application No. 59-138461 wherein an aperture for absorbing pressure waves of thermal energy is formed corresponding to the discharge openings.

Further, the present invention can be utilized effectively for the full-line type recording head the length of which corresponds to the maximum width of a recording medium recordable by such recording apparatus. For the full-line type recording head, it may be possible to adopt either a structure whereby to satisfy the required length by combining a plurality of recording heads or a structure arranged by one integrally formed recording head.

In addition, it may be possible to use an exchangeable chip type recording head which makes electrical connection with or ink supply from the main body of an apparatus possible when it is installed on the main body of the apparatus or it may be possible to use a cartridge type head having an ink tank integrally formed with the recording head itself.

Also, for the present invention, it is preferable to additionally provide a recording head with recovery means and preliminarily auxiliary means as constituents of the recording apparatus because these additional means contribute to stabilizing the effectiveness of the present invention more. To name them specifically, these are capping means, cleaning means, suction or compression means, pre-heating means such as electrothermal transducing devices or heating devices other than such transducing devices or the combination of those types of devices. Here, also, the performance of a pre-discharge mode making discharge other than the regular discharge is effective for the execution of stable recording.

In the embodiments of the present invention described above, while ink has been described as liquid, it may be an ink material which is solidified below the room temperature but liquefied at the room temperature. Here, also, since ink is generally controlled for the ink jet method within the temperature not lower than 30° C. and not higher than 70° C. to stabilize its viscosity to effectuate the stable discharges, ink may be such as to be liquefied when the applicable recording signals are given.

In addition, it may be possible to use ink which is liquefied only by the application of thermal energy, but solidified when left intact in order to positively prevent the temperature from rising due to the thermal energy by use of such energy as the energy which should be consumed for changing states of ink from solid to liquid, or to prevent ink from being evaporated. In either case, for the present invention, it may be possible to adopt the use of ink having a nature of being liquefied only by the application of thermal energy, such as ink capable of being discharged as ink liquid by enabling itself to be liquefied anyway when the thermal energy is given in accordance with recording signals, and ink which will have already begun solidifying itself by the time it reaches a recording medium. In such a case, it may be possible to retain ink in the form of liquid or solid in the recesses or through holes of a porous sheet such as disclosed in Japanese Patent Laid-Open application No. 54-56847 or 60-71260 in order to enable the ink to face the electrothermal transducing devices. In the present invention, the most effective method for the various kinds of ink mentioned above is the one which is capable of implementing the film boiling method as described above.

Moreover, as the mode of the recording apparatus in accordance with the present invention, it may be possible to adopt a copying machine combined with a reader, in addition to the image output terminal for a computer or other information processing apparatus, and also, it may be possible to adopt a mode of a facsimile equipment having transmitting and receiving functions.

Here, the present invention is either applicable to a system formed by plural equipment (such as a host computer, an interface device, a reader, a printer, among some others) or to a single apparatus formed by one device (such as a copying machine, a facsimile equipment, among some others).

Also, it is possible to achieve the objectives of the present invention by providing a system or an apparatus with a storage medium (or a recorded medium) having the programmed codes of a software stored on it to implement the functions of the aforesaid embodiments, and then, enabling the computer (or CPU or MPU) of the system or the apparatus to read out the stored programming codes on the storage medium for implementation thereof. In this case, the programming codes themselves which are read out from the storage medium implement the functions of the aforesaid embodiments. Therefore, it is construed that the storage medium that has stored such programming codes constitutes the present invention. Also, the present invention includes not only the case where the functions of the aforesaid embodiments are implemented by the execution of the programming codes read out by the computer, but also, the case where the operating system (OS) or the like, which is in operation on the computer, performs partly or totally the actual process on the basis of the instructions given by such programmed codes, and then, the functions of the aforesaid embodiments are implemented by the process thus executed.

Further, the present invention includes the case where the programmed codes are read out from the storage medium, and written on an expanded functional card inserted into the computer or on the memory provided for a expanded functional unit connected with the computer, and then, the functions of the aforesaid embodiments are implemented by the partial or total execution of the actual process by use of such expanded functional card or by the CPU or the like provided for such expanded functional unit on the basis of the instructions of the programmed codes thus written on the case or memory.

As described above, in accordance with the embodiments of the present invention, the platen that supports a recording medium with respect to a recording head is structured with a plurality of partitions. Then, it is arranged to hide the platen behind the recording medium when recording should be made on the edges of the recording medium, and then, to move the platen in the conveying direction of the recording medium. In this way, it is possible to obtain an effect that the entire area recording (no margin recording) is performed on a recording medium without staining the platen.

Also, in accordance with the embodiments described above, it becomes possible to provide an ink jet recording apparatus provided with the platen which is applicable to an recording medium of any size recordable by the apparatus, as well as the recording method therefor.

Also, in accordance with the present embodiments, it is anticipated to demonstrate an effect that images can be recorded on the entire area of a recording medium, while preventing the interior of the apparatus from being stained by ink discharge outside the recording medium.

What is claimed is:

1. A recording apparatus for recording an image on a recording medium using a recording head, comprising:

receiving means for receiving a signal from an apparatus external to the recording apparatus;

control means for conducting a first control of executing a recording operation regarding a recording area inside an edge or edges of the recording medium, and a second control of executing a recording operation regarding a recording area extending to an area outside the edge or edges of the recording medium;

convey control means for varying conveyance control of the recording medium between the first control and the second control;

a platen used for conveying the recording medium; and changing means for changing intervals of a plurality of supporting pieces of said platen in accordance with a size of the recording medium.

2. An apparatus according to claim 1, wherein said platen comprises a rotational shaft, and the plurality of supporting pieces protrude from the rotational shaft.

3. An apparatus according to claim 1, wherein said control means holds said platen in a fixed position in the first control of executing the recording operation regarding an area inside the edge of the recording medium.

4. An apparatus according to claim 1, wherein said control means controls rotation of said platen in order to position the supporting pieces of said platen behind the recording medium, at a side remote from the recording head, at the time of recording near the edge of the recording medium.

5. A recording apparatus for recording an image on a recording medium using a recording head, comprising:

receiving means for receiving a signal from an apparatus external to the recording apparatus;

control means for conducting a first control of executing a recording operation regarding a recording area inside an edge or edges of the recording medium, and a second control of executing a recording operation regarding a recording area extending to an area outside the edge or edges of the recording medium;

convey control means for varying conveyance control of the recording medium between the first control and the second control;

conveyance means, controlled by said convey control means, for conveying the recording medium;

recording medium containing means for containing the recording medium;

feeding means for feeding the recording medium contained in said recording medium containing means; and oblique conveyance correction means, arranged between said feeding means and said conveyance means, for correcting oblique conveyance of the recording medium by causing the recording medium fed from said feeding means to abut against said conveyance means.

6. An apparatus according to claim 5, wherein the recording head performs recording, while traveling in a direction substantially orthogonal to the conveying direction of the recording medium.

* * * * *